US011522278B2

(12) United States Patent
Shoji et al.

(10) Patent No.: US 11,522,278 B2
(45) Date of Patent: Dec. 6, 2022

(54) ANTENNA DEVICE, WINDOW GLASS FOR VEHICLE, AND WINDOW GLASS STRUCTURE

(71) Applicant: AGC Inc., Tokyo (JP)

(72) Inventors: Hideaki Shoji, Tokyo (JP); Shoichi Takeuchi, Tokyo (JP)

(73) Assignee: AGC INC., Tokyo (JP)

( * ) Notice: Subject to any disclaimer, the term of this patent is extended or adjusted under 35 U.S.C. 154(b) by 0 days.

(21) Appl. No.: 16/918,427

(22) Filed: Jul. 1, 2020

(65) Prior Publication Data

US 2020/0335857 A1 Oct. 22, 2020

Related U.S. Application Data

(63) Continuation of application No. PCT/JP2019/003416, filed on Jan. 31, 2019.

(30) Foreign Application Priority Data

Feb. 2, 2018 (JP) ..... JP2018-017048
Nov. 21, 2018 (JP) ..... JP2018-218345

(51) Int. Cl.
*H01Q 1/32* (2006.01)
*H01Q 1/12* (2006.01)
(Continued)

(52) U.S. Cl.
CPC ..... *H01Q 1/3283* (2013.01); *H01Q 1/1271* (2013.01); *H01Q 5/342* (2015.01);
(Continued)

(58) Field of Classification Search
CPC ..... H01Q 1/52; H01Q 5/30; H01Q 1/3283; H01Q 5/342; H01Q 1/1271; H01Q 19/138; H01Q 21/0031; H01Q 5/392; H01Q 21/28
See application file for complete search history.

(56) References Cited

U.S. PATENT DOCUMENTS 6,054,955 A * 4/2000 Schlegel, Jr. ..... H01Q 9/42 343/702
2005/0057419 A1* 3/2005 Pintos ..... H04B 7/10 343/810
(Continued)

FOREIGN PATENT DOCUMENTS

CN 102725910 A 10/2012
EP 1 091 444 A2 4/2001
(Continued)

OTHER PUBLICATIONS

International Searching Authority, "International Search Report," issued in connection with International Patent Application No. PCT/JP2019/003416, dated Apr. 16, 2019.
(Continued)

*Primary Examiner* — Andrea Lindgren Baltzell
*Assistant Examiner* — Yonchan J Kim
(74) *Attorney, Agent, or Firm* — Foley & Lardner LLP

(57) ABSTRACT

An antenna device includes a first conductor plate including a first end portion and a second end portion, the first conductor plate being provided with a first feeding portion between the first end portion and the second end portion, a second conductor plate including a third end portion connected to the first feeding portion, a fourth end portion located at a position away from the first conductor plate, and a plate surface of which width in a direction parallel to the first conductor plate increases with a distance from the third end portion toward the fourth end portion, and a third conductor plate including a fifth end portion capacitively coupling with the fourth end portion, a sixth end portion connected, on a same side as the first end portion with respect to the first feeding portion, to the first conductor plate, and a counter portion opposite the plate surface.

22 Claims, 15 Drawing Sheets

(51) Int. Cl.

| | |
|---|---|
| ***H01Q 21/28*** | (2006.01) |
| ***H01Q 5/392*** | (2015.01) |
| ***H01Q 5/342*** | (2015.01) |
| ***H01Q 19/13*** | (2006.01) |
| ***H01Q 21/00*** | (2006.01) |

(52) U.S. Cl.
CPC ..... *H01Q 5/392* (2015.01); *H01Q 19/138* (2013.01); *H01Q 21/0031* (2013.01); *H01Q 21/28* (2013.01)

(56) References Cited

U.S. PATENT DOCUMENTS

| | | | | |
|---|---|---|---|---|
| 2006/0227052 | A1* | 10/2006 | Tavassoli Hozouri | H01Q 9/36 343/700 MS |
| 2009/0051611 | A1* | 2/2009 | Shamblin | H01Q 9/42 343/747 |
| 2009/0115664 | A1* | 5/2009 | Chung | H01Q 5/371 343/848 |
| 2012/0098715 | A1* | 4/2012 | Dai | H01Q 1/1285 343/712 |
| 2013/0057443 | A1* | 3/2013 | Asanuma | H01Q 5/314 343/751 |
| 2016/0322709 | A1* | 11/2016 | Tao | H01Q 1/521 |
| 2017/0207538 | A1* | 7/2017 | Kummetz | H01Q 9/16 |
| 2017/0256865 | A1* | 9/2017 | Sikes | H01Q 9/0407 |
| 2019/0386384 | A1* | 12/2019 | Villa | H01Q 9/40 |
| 2019/0386385 | A1 | 12/2019 | Filatov | |
| 2020/0006844 | A1 | 1/2020 | Ortigosa | |
| 2020/0006850 | A1 | 1/2020 | Filatov | |

FOREIGN PATENT DOCUMENTS

| | | | | |
|---|---|---|---|---|
| JP | 2007-235395 | A | | 9/2007 |
| JP | 2011-239094 | A | | 11/2011 |
| JP | 2011239094 | A | * | 11/2011 |
| JP | 2016-167680 | A | | 9/2016 |
| TW | M327554 | U | | 2/2008 |

OTHER PUBLICATIONS

International Searching Authority, "Written Opinion," issued in connection with International Patent Application No. PCT/JP2019/003416, dated Apr. 16, 2019.

First Office Action issued in corresponding Chinese Patent Application No. 201980010727.9 dated Feb. 14, 2022.

* cited by examiner

ANTENNA DEVICE, WINDOW GLASS FOR VEHICLE, AND WINDOW GLASS STRUCTURE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2019/003416 filed on Jan. 31, 2019 and designating the U.S., which claims priority of Japanese Patent Application No. 2018-017048 filed on Feb. 2, 2018 and claims priority of Japanese Patent Application No. 2018-218345 filed on Nov. 21, 2018. The entire contents of the foregoing applications are incorporated herein by reference.

BACKGROUND OF THE INVENTION

1. Field of the Invention

The present invention relates to an antenna device, a window glass for a vehicle, and a window glass structure.

2. Description of the Related Art

In recent years, a trend for expanding high-speed and large-capacity communication infrastructures, such as a transition from 4G LTE to 5G (sub6), has emerged, and there is a trend that, in addition to the usage of the conventional 700 MHz to 3 GHz band, the used bands expand into 6 GHz bands. In contrast, the frequency bands used globally for 4G LTE mainly include 698 to 960 MHz and 1790 to 2690 MHz. Therefore, an antenna capable of receiving signals over a wide frequency band from 700 MHz to 6 GHz is desired as an antenna compatible with both 4G and 5G.

For example, as a UWB (Ultra Wide Band) antenna capable of reception over a wide frequency band, an antenna having a fan-shaped radiating element arranged to stand vertically from a ground plate is known (for example, see Japanese Laid-Open Patent Publication No. 2007-235395).

SUMMARY OF THE INVENTION

Technical Problem

However, the frequency that can be received by a UWB antenna having a fan-shaped radiating element arranged to stand vertically on a ground plane is for the most part determined by the length of the outer edge of the radiating element. For this reason, it is difficult to further broaden the receivable frequency range with the conventional technique.

Accordingly, the present disclosure provides an antenna device that can readily broaden the reception frequency range, and a window glass for a vehicle and a window glass structure including at least one of the above antenna devices.

Means for Solving the Problems

The present disclosure provides:

an antenna device comprising:

a first conductor plate including a first end portion and a second end portion on an opposite side from the first end portion, the first conductor plate being provided with a first feeding portion between the first end portion and the second end portion;

a second conductor plate including a third end portion connected to the first feeding portion, a fourth end portion located at a position away from the first conductor plate, and a plate surface of which width in a direction parallel to the first conductor plate increases with a distance from the third end portion toward the fourth end portion; and a third conductor plate including a fifth end portion capacitively coupling with the fourth end portion, a sixth end portion connected, on a same side as the first end portion with respect to the first feeding portion, to the first conductor plate, and a counter portion opposite the plate surface.

Advantageous Effects of Invention

According to the present disclosure, an antenna device that can readily broaden the receivable frequency range, and a window glass for a vehicle and a window glass structure including at least one of the above antenna devices can be provided.

DETAILED DESCRIPTION OF THE PREFERRED EMBODIMENTS

Hereinafter, an embodiment for carrying out the present invention will be described with reference to the drawings. In each embodiment, deviations from directions such as parallel direction, perpendicular direction, orthogonal direction, horizontal direction, vertical direction, height direction, width direction, and the like are tolerated to such an extent that the effects of the present invention are not impaired. An X-axis direction, a Y-axis direction, and a Z-axis direction represent a direction parallel to the X axis, a direction parallel to the Y axis, and a direction parallel to the Z axis, respectively. The X-axis direction, the Y-axis direction, and the Z-axis direction are orthogonal to each other. It should be noted that an antenna device and an antenna are synonymous.

Figure 1:
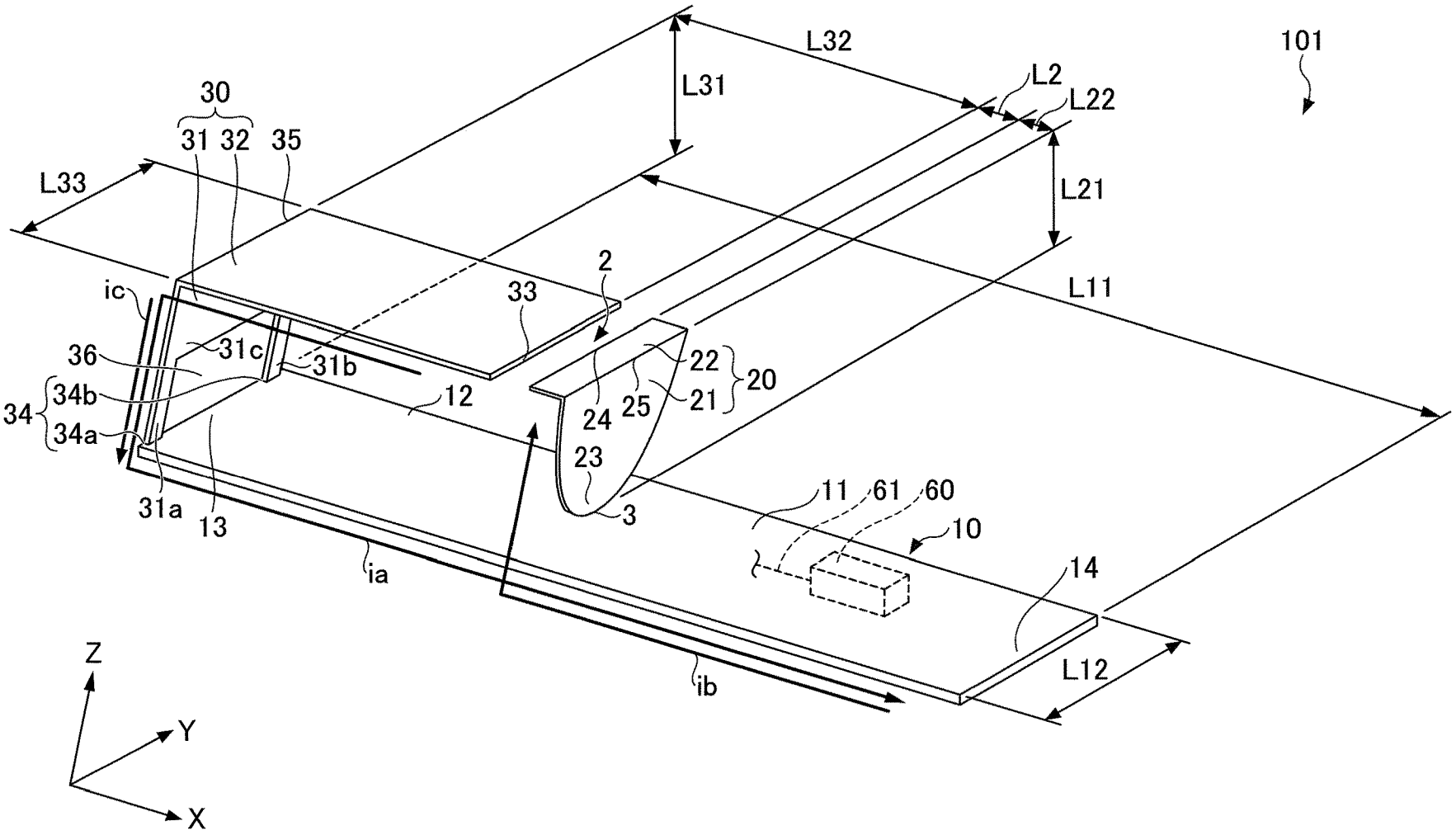
FIG. 1 is a perspective view illustrating an example of configuration of an antenna device according to the present embodiment.

FIG. 1 is a drawing illustrating an example of configuration of an antenna device according to the present embodiment. The antenna device 101 as illustrated in FIG. 1 includes a conductor plate 10, a conductor plate 20, and a conductor plate 30.

The conductor plate 10 is an example of a first conductor plate. The conductor plate 10 is provided with a feeding portion 3 having the conductor plate 10 as a ground reference. The feeding portion 3 is an example of a first feeding portion, and represents a feeding point of the antenna device 101. In the present embodiment, the conductor plate 10 includes an end portion 13 and an end portion 14 on an opposite side from the end portion 13. The end portion 13 and the end portion 14 are located apart from each other in the X-axis direction. The feeding portion 3 is provided between the end portion 13 and the end portion 14. The conductor plate 10 includes a first plate surface portion 12 extending from the feeding portion 3 to the end portion 13 and a second plate surface portion 11 extending from the feeding portion 3 to the end portion 14.

The conductor plate 20 is an example of a second conductor plate. The conductor plate 20 has an end portion 23 connected to the feeding portion 3 and an end portion 24 located away from the conductor plate 10. The end portion 24 is located on an opposite side from the end portion 23. More specifically, the end portion 24 is located on a side opposite the side where the conductor plate 10 exists, with respect to the end portion 23. The end portion 23 and the end portion 24 are located apart from each other in the Z-axis direction.

Further, the conductor plate 20 has a plate surface 21 of which the width in a direction parallel to the conductor plate 10 (in the case of FIG. 1, the Y-axis direction) increases with a distance from the end portion 23 toward the end portion 24. Herein, the direction parallel to the conductor plate 10 may be an X-axis direction but is preferably a direction inclined within a range of ±90 degrees with respect to the Y-axis direction. In particular, the direction parallel to the conductor plate 10 is more preferably within a range of ±45 degrees, still more preferably within a range of ±20 degrees, yet more preferably within a range of ±5 degrees with respect to the Y-axis direction, and most preferably, the direction parallel to the conductor plate 10 matches the Y-axis direction. The expression, "the conductor plate 20 increases in size with a distance from the end portion 23 toward the end portion 24", may include at least a portion enlarging with a distance from the end portion 23 toward the end portion 24, and may also include, for example, in accordance with being further away from the end portion 23 toward the end portion 24, a portion of which the width stays the same and a portion of which the width decreases. The conductor plate 20 preferably does not have such a portion of which the width decreases in accordance with being further away from the end portion 23 toward the end portion 24. Furthermore, the conductor plate 20 may be a flat shape without any bend, but may be a three-dimensional shape including a bent portion. The conductor plate 20 according to the present embodiment includes a plate surface 21 including the end portion 23 and a plate surface 22 including the end portion 24. The plate surface 22 is a portion that is bent at an angled portion 25 with respect to the plate surface 21. Since the bent plate surface 21 is provided, the height of the antenna device 101 can be reduced as compared with a configuration in which the bent plate surface 21 is not bent. The reduction of the height referred to herein corresponds to a reduction in the distance (height) in the Z-axis direction from the conductor plate 10.

The conductor plate 30 is an example of a third conductor plate. The conductor plate 30 includes an end portion 33 capacitively coupling with the end portion 24 of the conductor plate 20 and an end portion 34 connected to the conductor plate 10 on same side as the end portion 13 with respect to the feeding portion 3. The end portion 34 is located on an opposite side from the end portion 33. The end portion 33 and the end portion 34 are located away from each other in the Z-axis direction and the X-axis direction. In the present embodiment, the end portion 33 capacitively couples with the end portion 24 via a gap 2 having an interval allowing capacitive coupling. The direction of the gap 2 forming the capacitive coupling is not limited to the X-axis direction as illustrated in the drawing, and may be the Z-axis direction or the Y-axis direction. For example, the direction of the gap 2 forming the capacitive coupling may be a direction forming an angle of $\varphi$ degrees (0 degrees$<\varphi<$90 degrees) with respect to the plate surface 22 extending in the X-axis direction. The capacitive coupling between the end portion 24 and the end portion 33 may be achieved by other forms, such as a comb structure or dielectric loading.

In the present embodiment, the conductor plate 30 includes a counter portion 31 opposite the plate surface 21 of the conductor plate 20 in the X-axis direction and a counter portion 32 opposite the first plate surface portion 12 of the conductor plate 10 in the Z-axis direction. The counter portion 32 is a portion that is bent at an angled portion 35 with respect to the counter portion 31. The counter portion 32 includes an end portion 33, and the counter portion 31 includes an end portion 34.

In this manner, in the antenna device 101 according to the present embodiment, the conductor plate 20 is connected, at the end portion 23, to the feeding portion 3 which has the conductor plate 10 as the ground reference, and is formed so that the width of the plate surface 21 increases with a distance from the conductor plate 10. Therefore, when a length of an outer edge portion (for example, a curved line portion expanding from the end portion 23) of the plate surface 21 is set in such a manner the conductor plate 20 has an electrical length for operating in a desired frequency range, the conductor plate 20 can function as a radiating element of a UWB antenna.

Additionally, with the conductor plate 20 being connected, at the end portion 23, to the feeding portion 3 having the conductor plate 10 as a ground reference, and the end portion 24 of the conductor plate 20 capacitively couples with the end portion 33 of the conductor plate 30. Therefore, the conductor plate 20 functions as a feeding element feeding power to the conductor plate 30 through capacitive coupling. Also, the conductor plate 30 is connected, at the end portion 34, to the conductor plate 10. Therefore, since the conductor plate 20 capacitively couples with the conductor plate 30, the conductor plates 10, 30 obtained by combining the conductor plate 30 and the conductor plate 10 resonate as a single radiating element (i.e., a single J-shaped radiating element in the present embodiment) that is fed by the conductor plate 20 by capacitive coupling. Therefore, the conductor lengths of the conductor plate 30 and the conductor plate 10 are set in such a manner that the conductor plates 10, 30 have an electrical length for operating in a desired frequency range, so that the conductor plates 10, 30 can function as a radiating element operating at a resonance frequency different from the conductor plate 20.

In this manner, the antenna device 101 as illustrated in FIG. 1 includes a first antenna which not only operates in a first operation mode in which the conductor plate 20 operates as a radiating element but also operates in a second operation mode in which the conductor plate 20 operates as a feeding element and the conductor plates 10, 30 operate as a radiating element. In other words, since the conductor plates 10, 30 can resonate at a resonance frequency different from the resonance frequency of the conductor plate 20, the range of the frequency that can be received by the antenna device 101 can be readily broadened. In the first operation mode, the antenna device 101 resonates with a current ib flowing through the conductor plate 20 and a current is flowing through the conductor plate 30, and in the second operation mode, the antenna device 101 resonates with a current is flowing through the conductor plates 10, 30.

For example, the conductor plate 20 includes a first electrical length Le1 resonating at a first operation frequency f1, and the conductor plates 10, 30 have a second electrical length Le2 resonating at a second operation frequency f2 lower than the first operation frequency f1. As a result, the conductor plates 10, 30 can resonate at a resonance frequency lower than the lowest-order resonance frequency of the conductor plate 20.

For example, when the first electrical length Le1 is set to a quarter wavelength of the first operation frequency f1, the conductor plate 20 can resonate at the first operation frequency f1 while the size of the conductor plate 20 is reduced. For example, when the second electrical length Le2 is set to a quarter wavelength of the second operation frequency f2, the conductor plates 10, 30 can resonate at the second operation frequency f2 while the size of the conductor plates 10, 30 is reduced.

The first electrical length Le1 corresponds to a length obtained based on the shortest conductor length along the conductor plate 20 from the end portion 23 to the end portion 24 in view of a dielectric constant, a thickness, or the like of a substrate in contact with or in proximity to the conductor plate 20. The second electrical length Le2 corresponds to a length obtained based on the shortest conductor length along the conductor plates 10, 30 from the end portion 33 to the end portion 14 via the end portion 34 in view of a dielectric constant, a thickness, or the like of a substrate in contact with or in proximity to the conductor plates 10, 30.

It is preferable that the counter portion 31 of the conductor plate 30 and the plate surface 21 of the conductor plate 20 are apart from each other by an electrical length of a quarter wavelength of the first operation frequency f1. In this case, the antenna device 101 has a configuration in which the plate surface 21 through which the current ib flows and the counter portion 31 through which the current ic, of which the phase is inverted from the current ib, flows are apart by a quarter wavelength, and the counter portion 31 is grounded to the conductor plate 10. In this case, like array antennas and Yagi antennas, the directivity of the antenna device 101 can be oriented toward the end portion 14 in the X-axis direction. The counter portion 31 of the conductor plate 30 is preferably parallel to the plate surface 21 of the conductor plate 20, so that the directivity of the antenna device 101 can be oriented toward the end portion 14 in the X-axis direction.

The conductor plate 30 includes the counter portion 32 opposite the first plate surface portion 12 of the conductor plate 10. Since the counter portion 32 is provided, the directivity of the antenna device 101 can be readily adjusted. The counter portion 32 is preferably parallel to the first plate surface portion 12 of the conductor plate 10, so that the directivity can be readily adjusted. Since the conductor plate 30 is bent, the height of the antenna device 101 can be reduced as compared with a configuration in which the conductor plate 30 is not bent.

The shape of the plate surface 21 of the conductor plate 20 is preferably axisymmetric about a virtual line passing through the feeding portion 3 in the Z-axis direction, so that the directivity of the antenna device 101 can be made approximately symmetrical about the Z-axis direction. For example, the conductor plate 20 has a semi-circular plate surface 21. However, the shape of the plate surface 21 is not limited to a semicircular shape, and may be other shapes such as an inverted triangular or semielliptical shape. Also, a slot may be formed in the conductor plate 20.

The conductor plate 20 may be bent such that the end portion 24 comes into proximity with the end portion 33 as illustrated in the figure, so that the height of the antenna device 101 is reduced. The conductor length from the end portion 23 to the end portion 24 is preferably 100 mm or less from the viewpoint of reducing the height of the antenna device 101, and is more preferably 70 mm or less.

The end portion 23 located at a bottom portion of the plate surface 21 is connected to the feeding portion 3. The end portion 23 may be connected to the feeding portion 3 by directly being in contact with the feeding portion 3, or may be connected to the feeding portion 3 by capacitive coupling and the like.

The feeding portion 3 is preferably located at a central portion of the conductor plate 10 in a direction parallel to the plate surface 21 (i.e., a width direction of the plate surface 21 corresponding to the Y-axis direction in FIG. 1), so that the directivity of the antenna device 101 can be made approximately symmetrical about a direction normal to the plate surface 21 (X-axis direction in FIG. 1). The central portion referred to herein means a range of ±10% from the center in the width of the conductor plate 10 with respect to the width of the conductor plate 10. Preferably, the central portion is in a range of ±5% of the width, and more preferably, in the center of the width.

One end of the coaxial cable is connected to the feeding portion 3 directly by solder or the like or indirectly by a connector or the like. The other end of the coaxial cable is connected to a device having at least one of, for example, a transmission function and a reception function.

Figure 2:
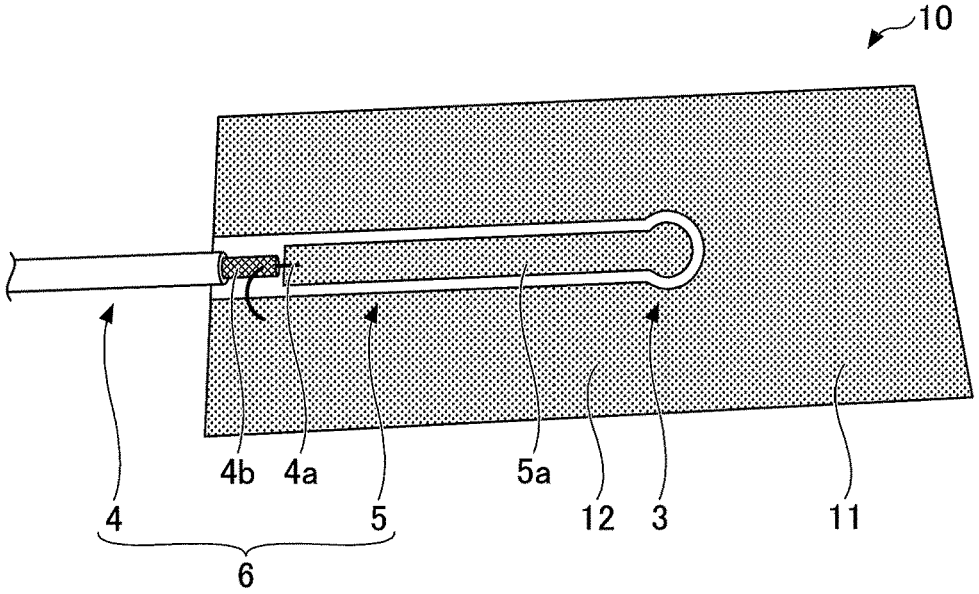
FIG. 2 is a drawing illustrating a first example of a feeding line connected to a feeding portion.

FIG. 2 is a drawing illustrating a first example of a feeding line connected to a feeding portion. The feeding line 6 connected to the feeding portion 3 includes a transmission line 5 using the conductor plate 10 as a ground, and a coaxial cable 4 connected to an end portion of the transmission line 5. The feeding line 6 is an example of a first feeding line. A core wire 4*a* of the coaxial cable 4 is connected to a strip conductor 5*a* of the transmission line 5, and is connected to the feeding portion 3 via the strip conductor 5*a*. An outer conductor 4*b* of the coaxial cable 4 is connected to the conductor plate 10 functioning as the ground.

Examples of the transmission line 5 include a microstrip line, a strip line, a coplanar waveguide with a ground plane (a coplanar waveguide with a ground plane arranged on a surface opposite to a conductor surface on which signal lines are formed), a coplanar strip line, and the like.

Figure 3:
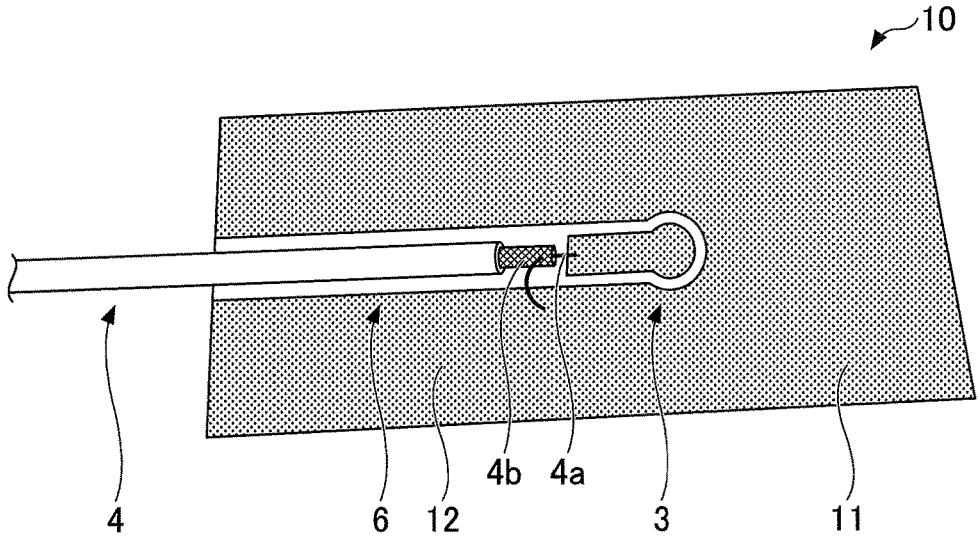
FIG. 3 is a drawing illustrating a second example of a feeding line connected to a feeding portion.

FIG. 3 is a drawing illustrating a second example of a feeding line connected to a feeding portion. A feeding line 6 connected to the feeding portion 3 includes a coaxial cable 4 connected to the feeding portion 3. A core wire 4*a* of the coaxial cable 4 is connected to the feeding portion 3. An outer conductor 4*b* of the coaxial cable 4 is connected to the conductor plate 10 functioning as the ground.

In FIG. 1, the counter portion 31 of the conductor plate 30 may include an opening portion 36. When the opening portion 36 is provided, the material of the counter portion 31 can be reduced, and the weight of the antenna device 101 can be reduced. In the present embodiment, the counter portion 31 is provided with the opening portion 36, so that the counter portion 31 includes wall portions 31*a*, 31*b*, 31*c* surrounding the opening portion 36. The wall portions 31*a*, 31*b* are located at both sides of the opening portion 36. The wall portion 31*a* is connected, at an end portion 34*a*, to the end portion 13 of the conductor plate 10. The wall portion 31*b* is connected, at an end portion 34*b*, to the end portion 13 of the conductor plate 10. The wall portion 31*c* is connected to the angled portion 35, and is also connected to the wall portion 31*a* and the wall portion 31*b*.

Also, a feeding line connected to the feeding portion 3 may pass through the opening portion 36. FIGS. 2, 3 illustrate examples in which the feeding line 6 penetrates the opening portion 36. Even if the opening portion 36 is not provided in the counter portion 31, radio frequency currents do not appreciably flow in the central portion of the counter portion 31, and are likely to flow along the outer edges of the counter portion 31. Therefore, when the opening portion 36 is provided in the central portion of the counter portion 31, the flows of the radio frequency currents along the outer edges of the counter portion 31 are less likely to be obstructed by the opening portion 36. Therefore, the impedance characteristics and the radiation characteristics of the antenna device 101 are not appreciably affected by the opening portion 36. Furthermore, if the feeding line 6 is passed through the opening portion 36 provided in the central portion of the counter portion 31, the degree of coupling is reduced between the radio frequency current flowing along the outer edges of the counter portion 31 and the radio frequency current flowing in proximity to the feeding line 6. Therefore, the impedance characteristics and the radiation characteristics of the antenna device 101 are not appreciably affected by the radio frequency current flowing in proximity to the feeding line 6 passing through the opening portion 36. For example, if the coaxial cable of the feeding line 6 crosses a side edge of the conductor plate 10 located in the Y-axis direction instead of passing through the opening portion 36 in the X-axis direction, the radio frequency current flowing along the side edge is likely to couple with the radio frequency current flowing around the coaxial cable. This coupling may disturb the impedance characteristics and the radiation characteristics.

Figure 4:
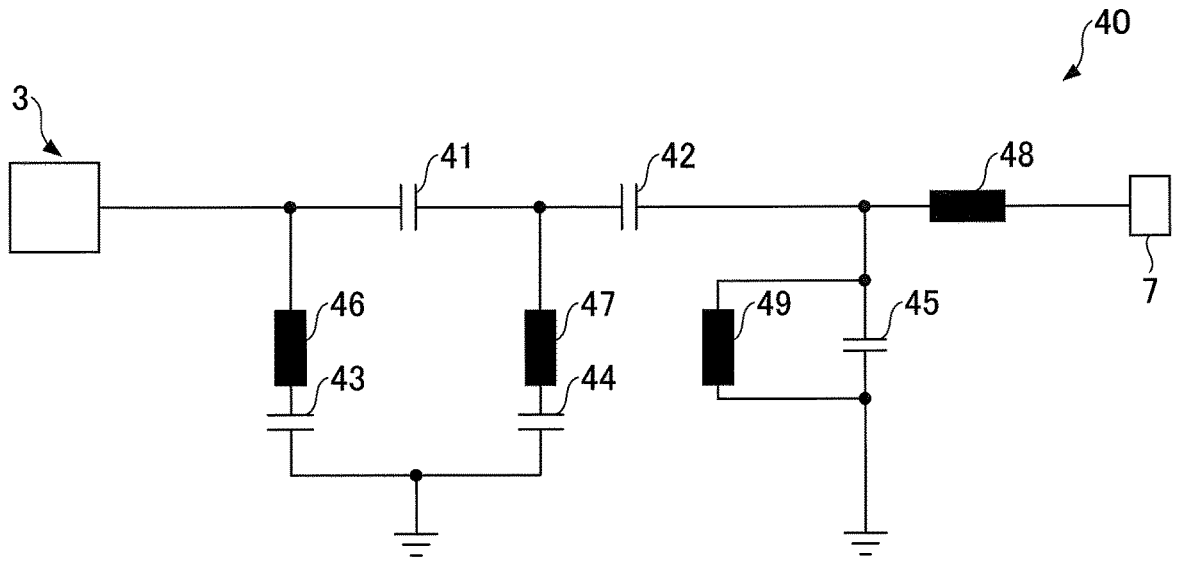
FIG. 4 is a drawing illustrating an example of configuration of a matching circuit.

The feeding portion 3 may be connected to the coaxial cable 4 via a matching circuit, which can further broaden the frequency range to which the antenna device 101 can be matched. FIG. 4 is a drawing illustrating an example of configuration of the matching circuit. The matching circuit 40 is connected between the feeding portion 3 and a port 7. One end of the coaxial cable is connected to the port 7. The matching circuit 40 includes capacitors 41 to 45 and inductors 46 to 49. The constants of the elements in the matching circuit 40 may be appropriately set according to the desired frequency band to which the matching circuit 40 is to be matched.

Figure 5:
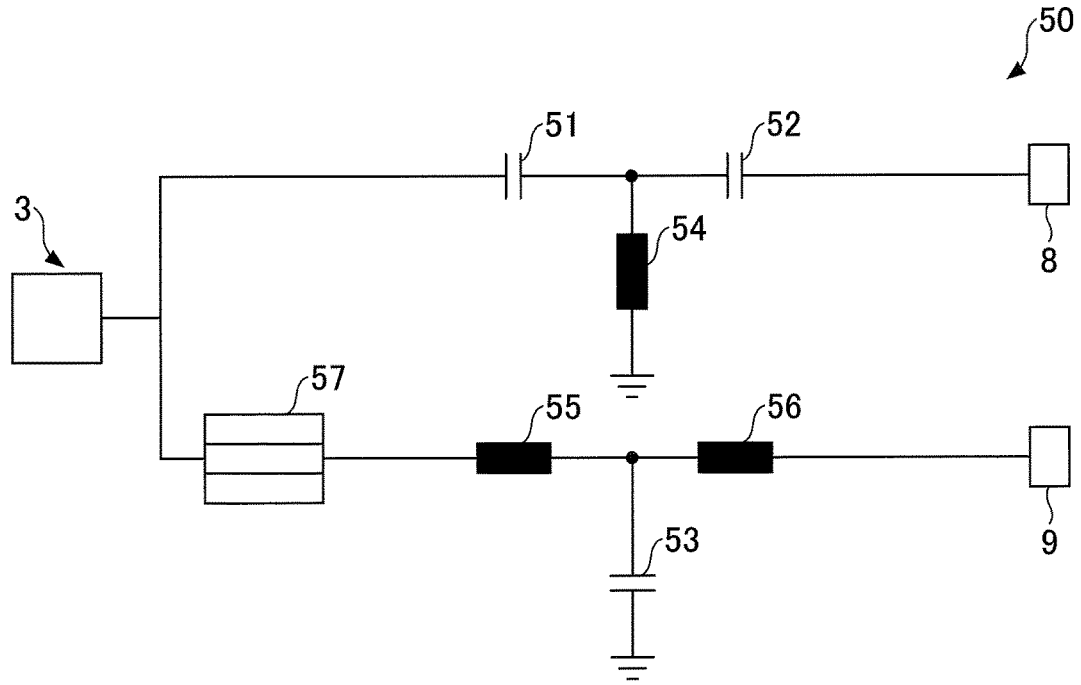
FIG. 5 is a drawing illustrating an example of configuration of a duplexer.

The feeding portion 3 may be connected to the coaxial cable 4 via a duplexer. When the duplexer is provided, the single antenna device 101 can be shared by multiple communication devices using different frequency bands. FIG. 5 is a drawing illustrating an example of configuration of a duplexer. The duplexer 50 is connected between the feeding portion 3 and the ports 8, 9. The port 8 is a terminal for retrieving low frequency-side electromagnetic waves received by the antenna device 101. The port 9 is a terminal for retrieving the high frequency-side electromagnetic waves received by the antenna device 101. The port 8 is connected to one end of a coaxial cable for the low frequency-side electromagnetic wave, and is connected to, for example, an LTE communication device via the coaxial cable. The port 9 is connected to one end of a coaxial cable for high frequency-side electromagnetic waves, and is connected to, for example, a communication device for inter-vehicle communication or road-to-vehicle communication via the coaxial cable. The duplexer 50 includes a phase shifter 57, capacitors 51 to 53, inductors 54 to 56. The phase shifter 57 is connected between the feeding portion 3 and the inductor 55. The constants of the elements in the duplexer 50 may be appropriately set according to the desired frequency band to which the duplexer 50 is to be matched.

In FIG. 1, the antenna device 101 according to the present embodiment may be configured to have a second antenna 60 provided on the second plate surface portion 11 of the conductor plate 10. When a feeding line 61 connected to the feeding portion of the second antenna 60 passes through the opening portion 36, the impedance characteristics and the radiation characteristics of the antenna device 101 are less affected by radio frequency currents flowing in proximity to the feeding line 61. A duplexer connected to the feeding portion 3 of the conductor plate 20 and the feeding portion of the second antenna 60 may be provided. The second antenna 60 is, for example, an antenna for a satellite positioning system such as GPS.

Figure 6:
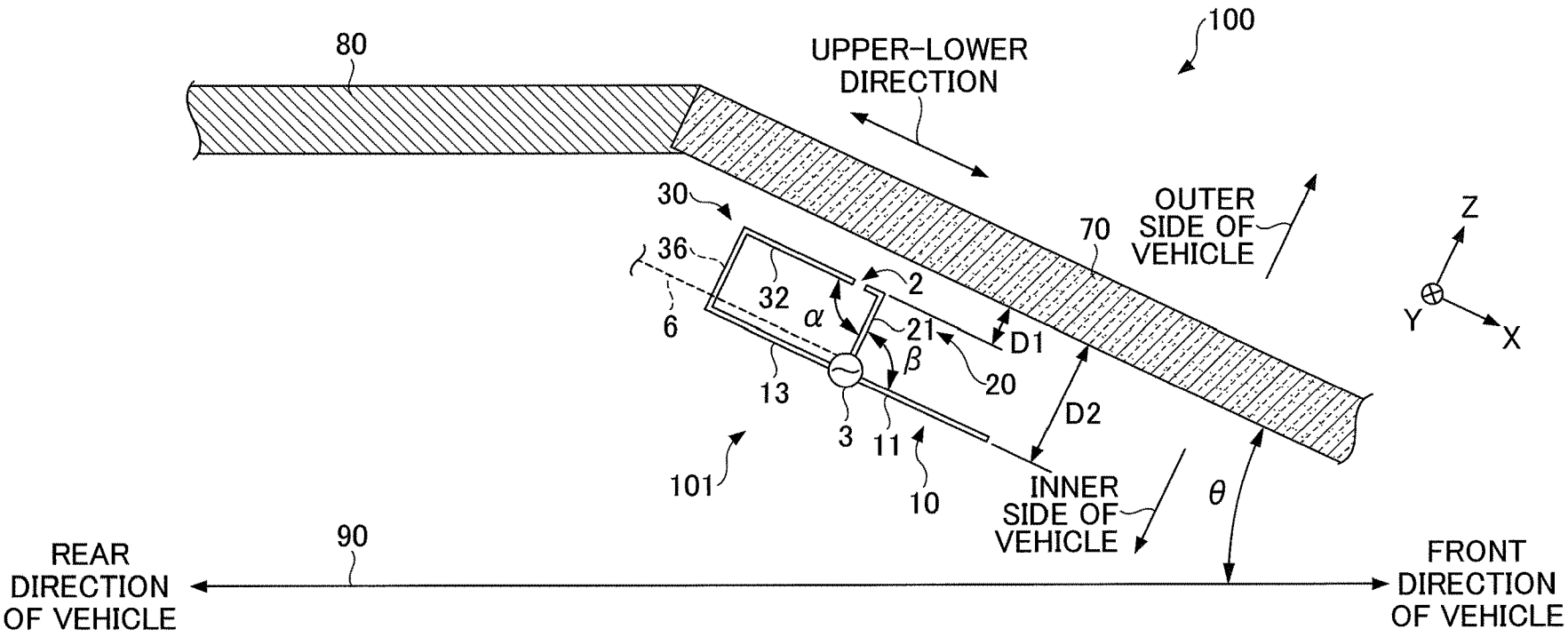
FIG. 6 is a cross sectional view schematically illustrating an example of configuration of an antenna device-attached window glass for a vehicle.

FIG. 6 is a cross sectional view schematically illustrating an example of configuration of an antenna device-attached window glass for a vehicle, and illustrates a cross section in a plane perpendicular to the vehicle-width direction. In FIG. 6, the Y-axis direction represents the vehicle-width direction of the vehicle 80. FIG. 6 illustrates a case in which the glass plate 70 is a windshield. The glass plate 70 is attached to a window frame of the vehicle 80 at an angle θ with respect to the horizontal plane 90. The angle θ is an angle greater than 0 degrees and less than 90 degrees (for example, 30 degrees). By adjusting the length of the antenna device 101 in the direction normal to the glass plate 70, the directivity of the antenna device 101 can be adjusted according to the types of vehicles even if the angles θ are different among the types of vehicles.

A window glass 100 for a vehicle includes a glass plate 70 for the windows of the vehicle 80 and an antenna device 101 attached to the glass plate 70. The antenna device 101 is attached to the glass plate 70 by an attachment member, not illustrated.

At this occasion, since at least one of the conductor plate 20 and the conductor plate 30 is brought into proximity with the glass plate 70 at a distance D1, the shortening effect due to the glass plate 70, which is a dielectric, can be obtained, and the size of the antenna device 101 can be reduced. In addition, since the conductor plate 10 is brought into proximity with the glass plate 70 at a distance D2, the shortening effect due to the glass plate 70, which is a dielectric, can be obtained, and the size of the antenna device 101 can be reduced.

The distance D1 represents the shortest distance (an example of a first distance) between the conductor plate 20 or the conductor plate 30 and a vehicle-inner-side surface of the glass plate 70. The distance D2 represents the shortest distance (an example of a second distance) between the conductor plate 10 and the vehicle-inner-side surface of the glass plate 70. Since the distance D1 and the distance D2 are different, the antenna device 101 can be formed in a three-dimensional shape having an element with a Z-axis direction component.

The directivity of a planar antenna device without a Z-axis direction component tends to be strong in the direction normal to the glass plate 70. Conversely, the antenna device 101 according to the present embodiment has an element having a Z-axis direction component, and therefore, the direction in which the directivity of the antenna device 101 becomes stronger is inclined in a direction closer to the horizontal plane 90 rather than the direction normal to the glass plate 70. Therefore, according to the antenna device 101 according to the present embodiment, the directivity in the direction parallel to the horizontal plane 90 (horizontal direction) is improved, so that the antenna gain (operation gain) in the horizontal direction can be further increased.

Also, the antenna device 101 according to the present embodiment has a bent-shaped element. When the comparison is performed at the same antenna length, the height of the antenna device 101 with the element having many bent portions can be readily reduced relative to a non-bent antenna. When the element is bent at two or more portions, the height (D2−D1) can be readily reduced while a predetermined antenna length is maintained. Therefore, this can reduce a large protrusion protruding from the vehicle-inner-side surface of the glass plate 70, and the antenna device 101 is less likely to be an obstacle for the occupants.

In the antenna device 101 according to the present embodiment, the counter portion 32 of the conductor plate 30 and the second plate surface portion 11 of the conductor plate 10 are coupled by a relatively strong capacitive coupling by the conductor plate 20 formed with the plate surface 21 having the Z-axis direction component. With such coupling, the counter portion 32 and the second plate surface portion 11 are not opposite each other, or conductive portions opposite each other are relatively small (i.e., narrow), and accordingly, the capacitive coupling between the counter portion 32 and the second plate surface portion 11 is less likely to become strong. Therefore, according to the antenna device 101 in the present embodiment, good impedance matching can be obtained.

Further, as illustrated in FIG. 6, from the viewpoint of improving the horizontal directivity, it is preferable that the distance D1 is shorter than the distance D2. It should be noted that the distance D1 may be zero. When the distance D1 is zero, at least one of the conductor plate 20 and the conductor plate 30 is in contact with the vehicle-inner-side surface of the glass plate 70.

In the embodiment illustrated in FIG. 6, the antenna device 101 is arranged in an upper portion on the vehicle-inner-side of the glass plate 70, so that the counter portion 32 and the conductor plate 10 become parallel to the vehicle-inner-side surface of the glass plate 70. The angle α represents an angle formed by the counter portion 32 and the plate surface 21, and the angle β represents an angle formed by the plate surface 21 and the conductor plate 10. The angle α is an angle (for example, 90 degrees) larger than 0 degrees and smaller than 180 degrees, and the angle β is an angle (for example, 90 degrees) larger than 0 degrees and smaller than 180 degrees. The angle α and the angle β are preferably right angles, but may be angles other than a right angle (for example, 45 degrees).

The counter portion 32 and the conductor plate 10 are not limited to being arranged parallel to the vehicle-inner-side surface of the glass plate 70, and may be arranged not parallel to the vehicle-inner-side surface. The angle α and the angle β may be the same angle or different angles.

The antenna device according to the present embodiment is suitable for transmission and reception of electromagnetic waves in the UHF (Ultra High Frequency) and SHF (Super High Frequency) bands.

For example, the antenna device is suitable for transmission and reception of electromagnetic waves in three bands (0.698 GHz to 0.96 GHz, 1.71 GHz to 2.17 GHz, and 2.4 GHz to 2.69 GHz) among multiple frequency bands used for LTE (Long Term Evolution). Also, the antenna device is suitable for transmission and reception of electromagnetic waves in the frequency band of 5G (sub6).

Further, the antenna device according to the present embodiment is also suitable for transmission and reception of electromagnetic waves in the ISM (Industry Science Medical) band. The ISM bands include 0.863 GHz to 0.870 GHz (Europe), 0.902 GHz to 0.928 GHz (United States), and 2.4 GHz to 2.5 GHz (worldwide). The communication standards using the 2.4 GHz band, which is one of the ISM bands, include a wireless LAN (Local Area Network) of the DSSS (Direct Sequence Spread Spectrum) method based on IEEE802.11b, Bluetooth (registered trademark), and some of the FWA (Fixed Wireless Access) systems.

FIGS. 7 to 10 are figures illustrating an example of a simulation result of the directivity of the antenna device 101 attached to a windshield as illustrated in FIG. 6 with regard to vertically polarized electromagnetic waves. The windshield is assumed to be inclined 30 degrees with respect to the horizontal plane.

Figure 7:
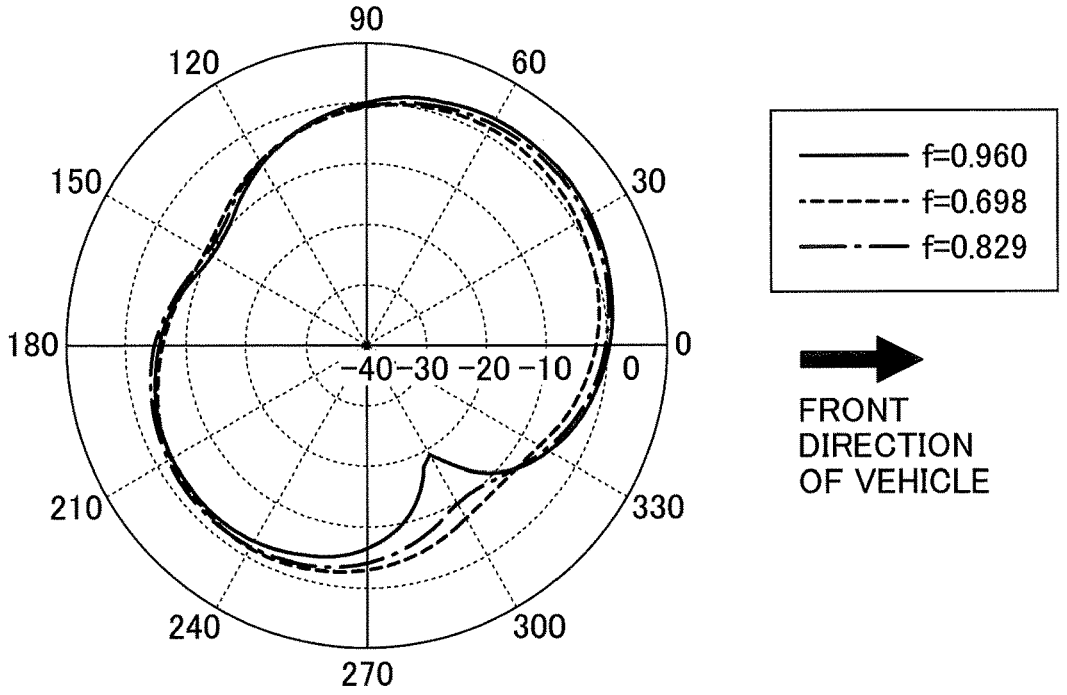
FIG. 7 illustrates an example of a radiation pattern in the vertical plane in a low frequency band of an antenna device.
Figure 8:
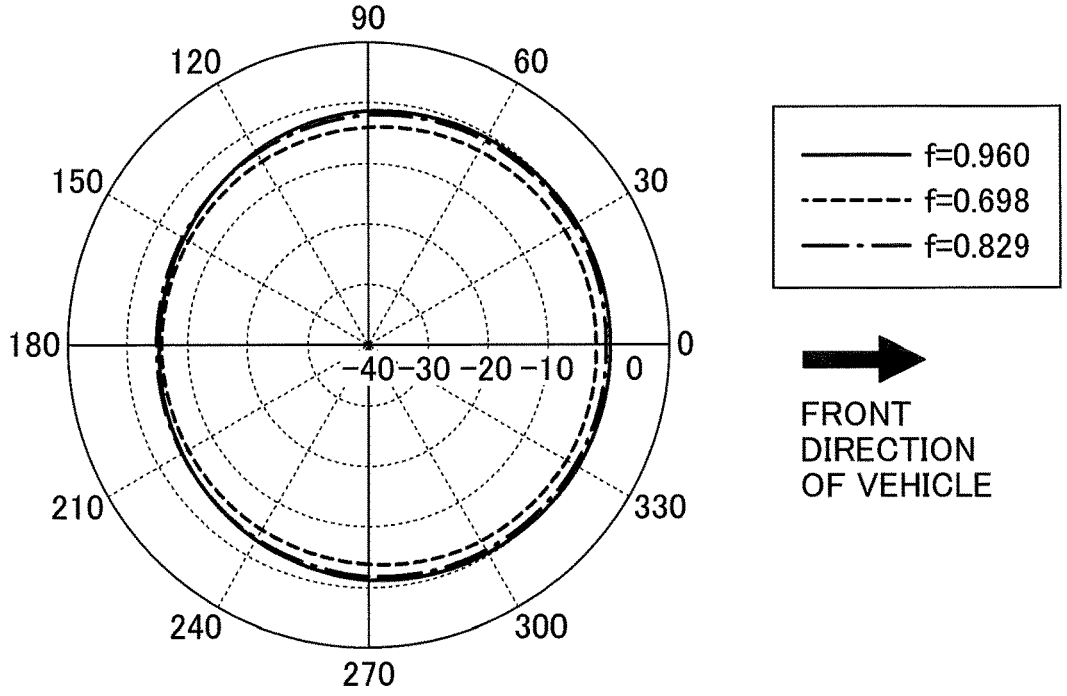
FIG. 8 illustrates an example of a radiation pattern in the horizontal plane in a low frequency band of the antenna device.
Figure 9:
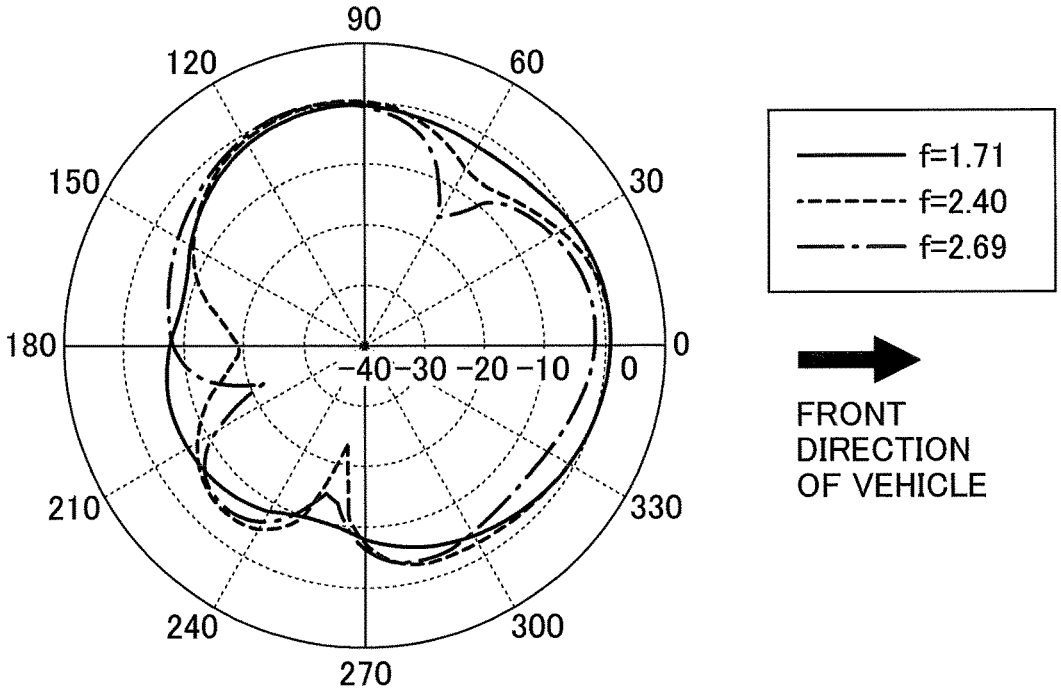
FIG. 9 illustrates an example of a radiation pattern in the vertical plane in a high frequency band of the antenna device.
Figure 10:
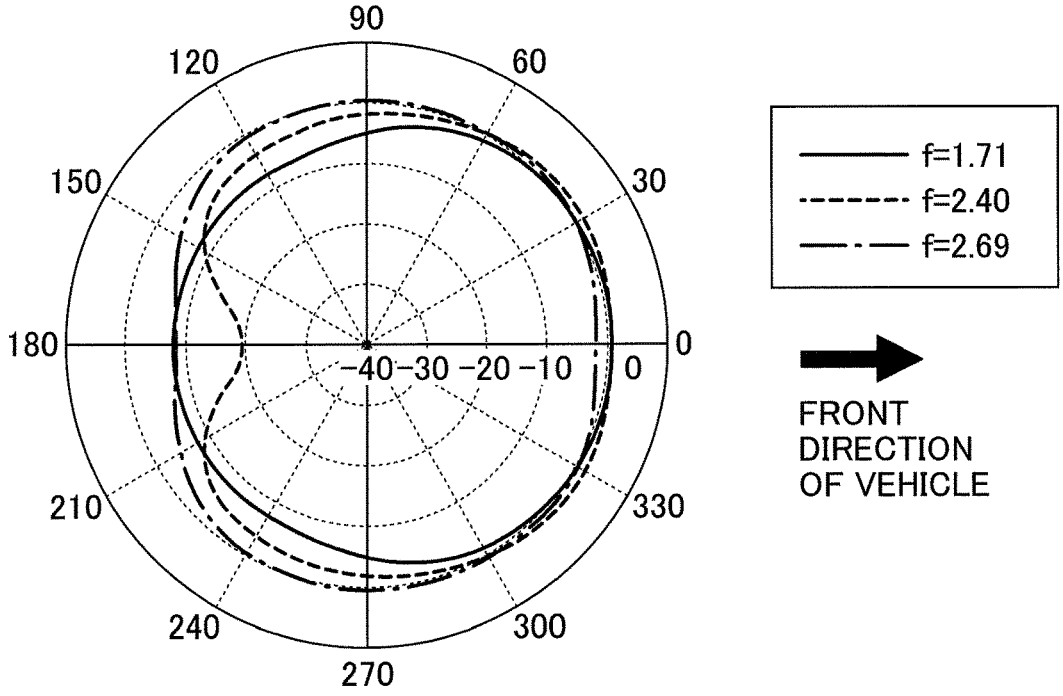
FIG. 10 illustrates an example of a radiation pattern in the horizontal plane in a high frequency band of the antenna device.

FIG. 7 illustrates antenna gains measured at three frequencies f (0.698 GHz, 0.829 GHz, 0.960 GHz) in a low frequency band of the antenna device 101 within the vertical plane perpendicular to the horizontal plane. FIG. 8 illustrates antenna gains measured at three frequencies f (0.698 GHz, 0.829 GHz, 0.960 GHz) in a low frequency band of the antenna device 101 within the horizontal plane. FIG. 9 illustrates antenna gains measured at three frequencies f (1.71 GHz, 2.40 GHz, 2.69 Hz) in a high frequency band of the antenna device 101 within the vertical plane perpendicular to the horizontal plane. FIG. 10 illustrates antenna gains measured at three frequencies f (1.71 GHz, 2.40 GHz, 2.69 GHz) in the high frequency band of the antenna device 101 within the horizontal plane.

The right side, left side, upper side, and lower side of the concentric circles illustrated in FIGS. 7 and 9 indicate a vehicle-front direction, a vehicle-rear direction, a vehicle-upper direction, and a vehicle-lower direction, respectively, when the antenna device located in the center of each concentric circle is seen in the vehicle-width direction. A right side, a left side, an upper side, and a lower side of the concentric circles illustrated in FIGS. 8 and 10 indicate a vehicle-front direction, a vehicle-rear direction, a vehicle-left direction, and a vehicle-right direction, respectively, when the antenna device located in the center of each concentric circle is seen from above.

In FIGS. 7 to 10, the unit of the antenna gain is "dBi". As illustrated in FIGS. 7 to 10, a directivity in the vehicle-front direction was able to be given in both of the low and high frequency bands.

When the antenna gains as illustrated in FIGS. 7 to 10 were measured, the sizes of respective portions of the antenna device 101 as illustrated in FIG. 1 were as follows, which are expressed in a unit of "mm".

L2: 4
L11: 95
L12: 40
L21: 19
L22: 5
L31: 20
L32: 30
L33: 40

Figure 11:
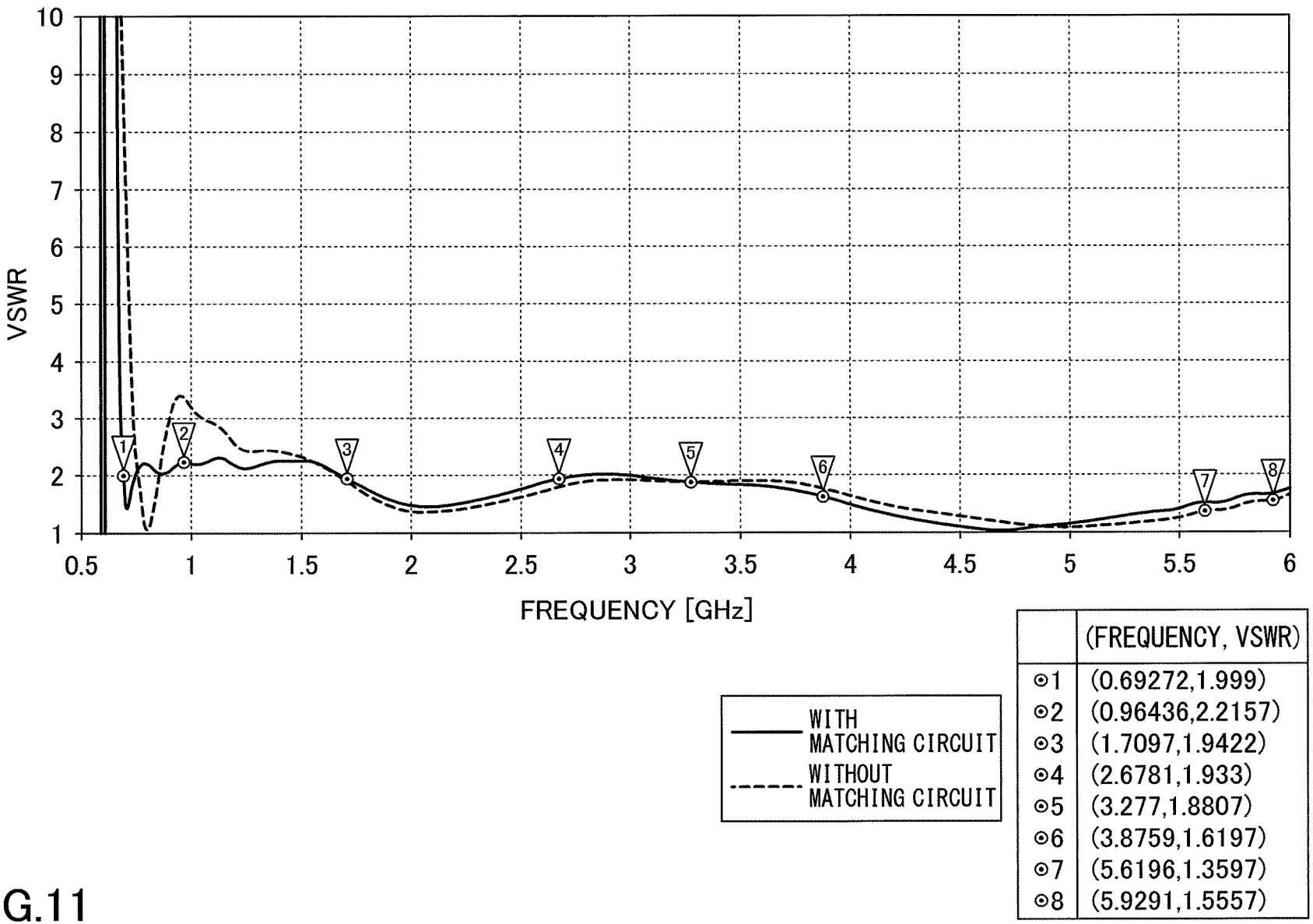
FIG. 11 illustrates an example of frequency characteristics of a VSWR (voltage standing wave ratio) of the antenna device.

FIG. 11 illustrates an example of frequency characteristics of a voltage standing wave ratio (VSWR) of the antenna device 101. With respect to the characteristics of the antenna, the VSWR is preferably as close to 1 as possible. Even when the matching circuit 40 was not connected to the feeding portion 3, the frequency band was sufficiently broadened, but when the matching circuit 40 was connected to the feeding portion 3, the VSWR was able to be further reduced in a range of 698 MHz to 960 MHz, which means that the frequency band was further broadened.

When the VSWRs as illustrated in FIG. 11 were measured, the sizes of respective portions of the antenna device 101 as illustrated in FIG. 1 were the same as those when the antenna gains as illustrated in FIGS. 7 to 10 were measured.

Figure 12:
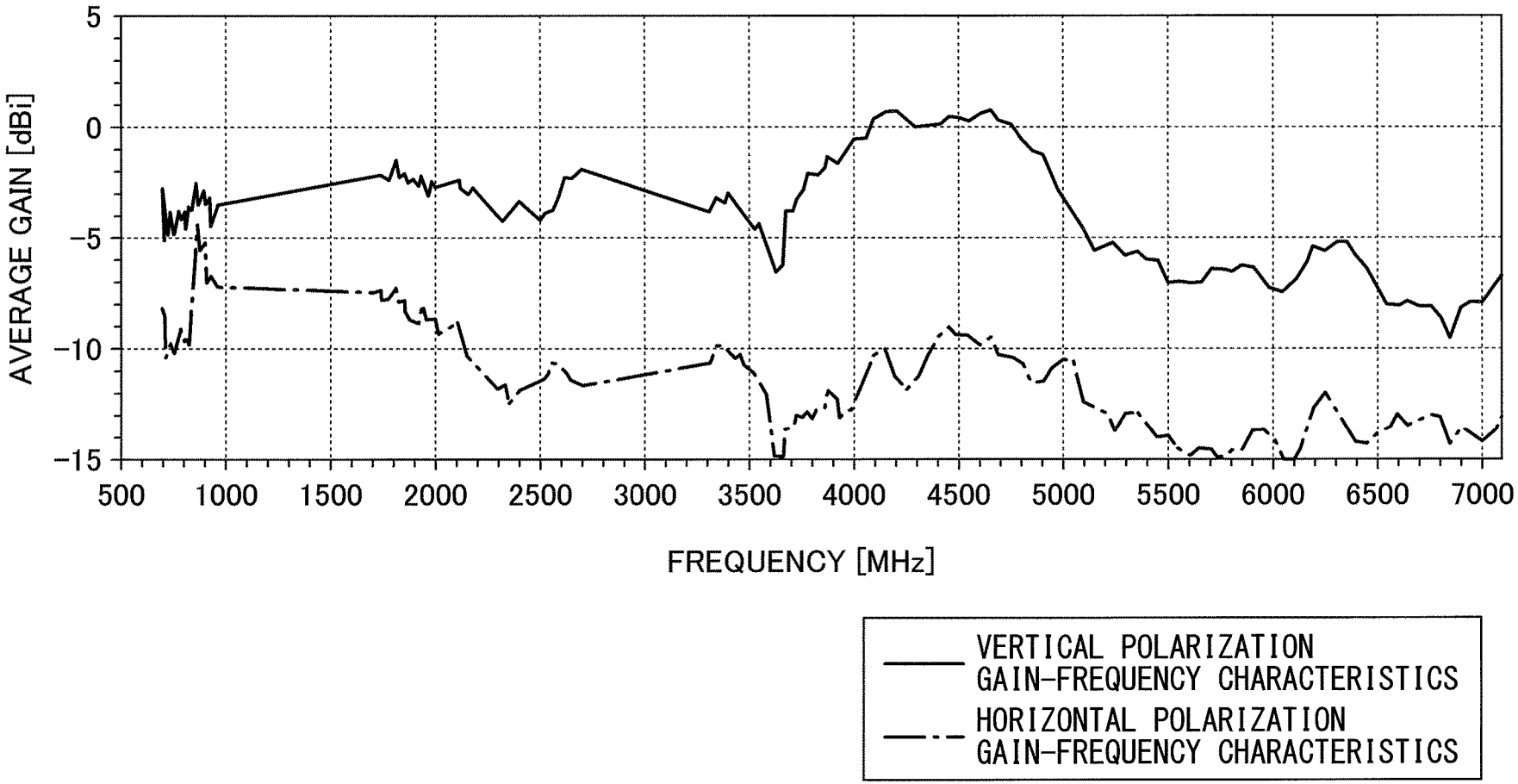
FIG. 12 illustrates an example of frequency characteristics (699 to 7100 MHz) of averaged gains in the horizontal plane.

FIG. 12 illustrates an example of frequency characteristics (699 to 7100 MHz) of averaged gains in the horizontal plane of the antenna device 101 for the horizontal polarization and the vertical polarization. In FIG. 12, the vertical axis represents a value obtained by averaging the antenna gains (operation gains) in respective azimuth directions from 0 degrees to 360 degrees in parallel to the horizontal plane, with regard to reception of horizontally polarized (or vertically polarized) electromagnetic waves. As illustrated in FIG. 12, the antenna gain of the antenna device 101 in the horizontal direction for transmission and reception of vertically polarized electromagnetic waves was sufficiently higher than those for horizontally polarized electromagnetic waves. In a band from the LTE frequency band (0.698 GHz to 0.96 GHz) to the 5G (sub) frequency band (6 GHz), the antenna gains of the antenna device 101 in the horizontal direction were sufficiently high values for transmitting and receiving vertically polarized electromagnetic waves.

Figure 13:
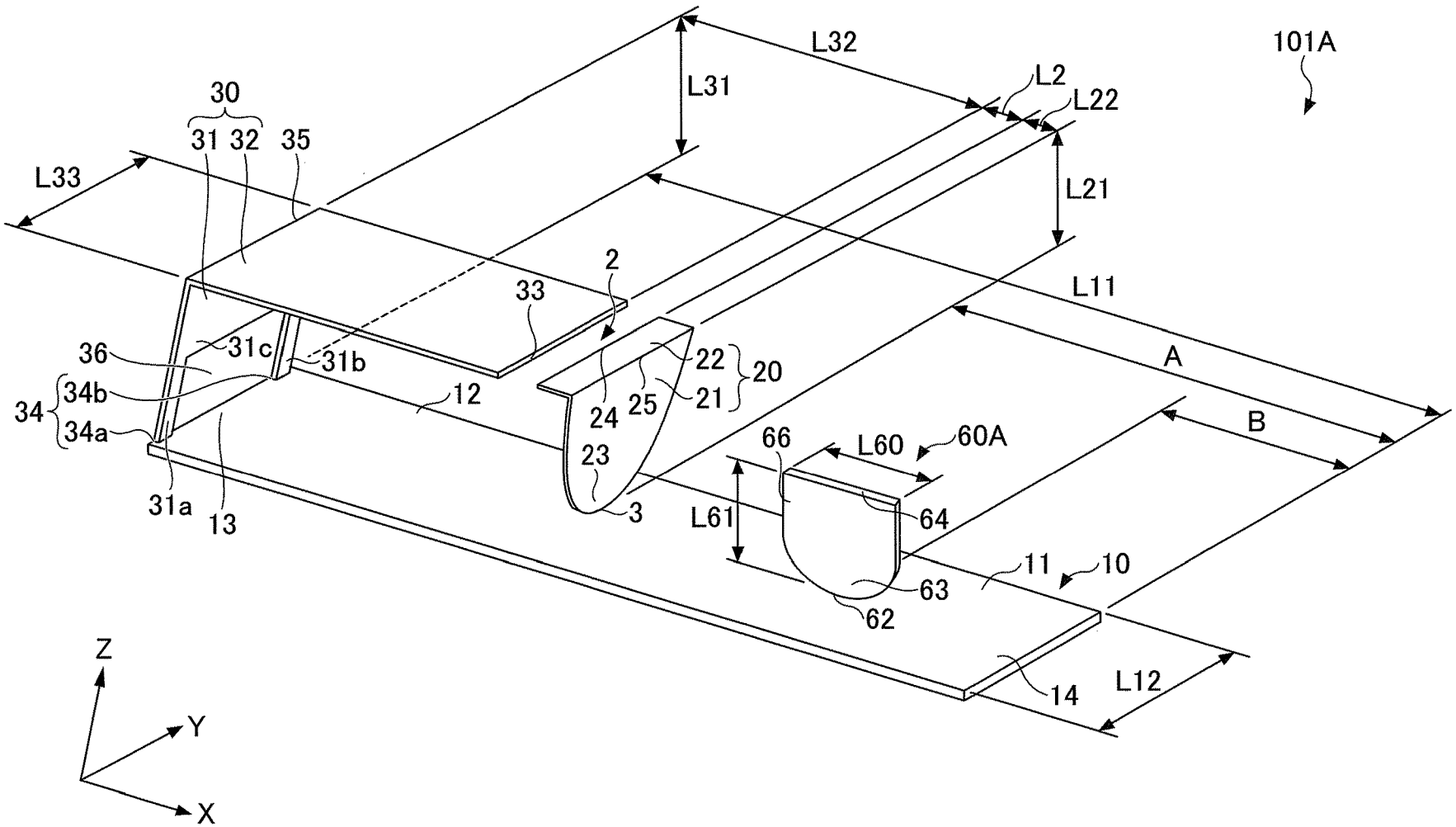
FIG. 13 is a perspective view illustrating a first modification of the configuration of the antenna device according to the present embodiment.

FIG. 13 is a perspective view illustrating a first modification of the configuration of the antenna according to the present embodiment. An antenna device 101A as illustrated in FIG. 13 is the first modification of the configuration of the antenna device 101. The antenna device 101A includes a second antenna 60A and a second feeding portion 62. The second antenna 60A is an example of the second antenna 60. With regard to configurations and effects of the antenna device 101A according to the first modification similar to the configurations and effects of the antenna device 101, the explanation thereabout is omitted by incorporating the above explanation herein by reference.

The second antenna 60A is provided on the same side as the end portion 14 with respect to the plate surface 21. The feeding portion 62 is provided on the conductor plate 10, and is a feeding point for feeding power to the second antenna 60A. The feeding portion 62 is located between the end portion 14 and the feeding portion 3. Since the antenna device 101A has such a configuration, the antenna device 101A operates in a first operation mode in which the conductor plate 20 operates as a radiating element, a second operation mode in which the conductor plates 10, 30 operate as a radiating element, and a third operation mode in which the second antenna 60A operates as a radiating element. In other words, the single antenna device 101A can achieve three operation modes. Since the second antenna 60A is provided on the same side as the end portion 14 with respect to the plate surface 21, a space above the second plate surface portion 11 of the conductor plate 10 is used efficiently. Therefore, the reduction in the size of the antenna device 101A operating in a plurality of operation modes can be readily achieved.

The antenna device 101A includes multiple radiating elements for which power are fed to two respective feeding portions 3, 62. Therefore, the antenna device 101A can be used as a MIMO (Multiple Input and Multiple Output) antenna or a diversity antenna.

The radiating elements (the conductor plates 10, 20, 30) fed by the feeding portion 3 and the radiating element (second antenna 60A) fed by the feeding portion 62 can be formed so as to be able to transmit and receive electromagnetic waves in frequency bands overlapping each other.

Next, the configuration of the antenna device 101A will be explained in more details.

The second antenna 60A is, for example, a conductor plate formed so as to be able to transmit and receive electromagnetic waves in a desired frequency band. The second antenna 60A is formed to be able to transmit and receive electromagnetic waves in a frequency band (1.71 to 6 GHz) including, for example, LTE and 5G bands, and may be formed to be able to transmit and receive electromagnetic waves in other frequency bands.

The second antenna 60A includes an end portion 63 connected to the feeding portion 62 and an end portion 64 located at a position away from the conductor plate 10. The end portion 64 is located at a side opposite from the end portion 63, and more specifically, the end portion 64 is located at an opposite side of the end portion 63 from the conductor plate 10. The end portion 63 and the end portion 64 are located away from each other in the Z-axis direction. In order to secure the gain over a broad frequency band and secure the horizontal plane symmetry of the directivity, the feeding portion 62 may be arranged preferably in a range of ±10% from the center in the width of the conductor plate 10 with respect to the width of the conductor plate 10, more preferably in a range of ±5% with respect to the width, and most preferably arranged at the center of the width.

The second antenna 60A of FIG. 13 includes a plate surface 66 of which the width in a direction parallel to the conductor plate 10 (in the case of FIG. 13, the X-axis direction) increases with a distance from the end portion 63 toward the end portion 64. The plate surface 66 is an example of a second plate surface. The second antenna 60A may be configured such that, when the feeding portion 62 is at a fixed position on the conductor plate 10, the plate surface 66 may be oriented in any direction. Herein, the direction parallel to the conductor plate 10 is not limited to the X-axis direction as illustrated in FIG. 13, and may be a direction inclined within a range of ±90 degrees with respect to the X-axis direction, and is, for example, the Y-axis direction. The expression, "the plate surface 66 increases in size with a distance from the end portion 63 toward the end portion 64", may include at least a portion enlarging with a distance from the end portion 63 toward the end portion 64, and may also include, for example, in accordance with being further away from the end portion 63 toward the end portion 64, a portion of which the width stays the same and a portion of which the width decreases. The plate surface 66 preferably does not have the portion of which the width decreases in accordance with being further away from the end portion 63 toward the end portion 64. Furthermore, the second antenna 60A may be a flat shape without any bend, but may be a three-dimensional shape including a bent portion just like the conductor plate 20. When the second antenna 60A is provided with a bent plate surface 66, the height of the antenna device 101A can be reduced as compared with a configuration in which the plate surface 66 is not bent. The reduction of the height referred to herein corresponds to a reduction in the distance (height) in the Z-axis direction from the conductor plate 10.

In this manner, in the antenna device 101A according to the present embodiment, the second antenna 60A is connected, at the end portion 63, to the feeding portion 62, and is formed so that the width of the plate surface 66 increases with a distance from the conductor plate 10. Therefore, when a length of an outer edge portion (for example, a curved line portion expanding from the end portion 63) of the plate surface 66 is set in such a manner the second antenna 60A has an electrical length for operating in a desired frequency range, the second antenna 60A can function as a radiating element of a UWB antenna.

The shape of the plate surface 66 of the second antenna 60A is preferably axisymmetric about a virtual line passing through the feeding portion 62 in the Z-axis direction, so that the directivity of the second antenna 60A can be made approximately symmetrical about the Z-axis direction. However, the shape of the plate surface 66 is not limited to axisymmetry. The shape of the second antenna 60A may have, for example, a plate surface 66 in a semicircular shape, or may have other shapes such as an inverted triangular or semielliptical shape. Also, a slot may be formed in the plate surface 66.

The second antenna 60A may be bent such that the end portion 64 comes into proximity with the end portion 63 in a manner similar to the conductor plate 20, so that the height of the antenna device 101A is reduced. The conductor length from the end portion 63 to the end portion 64 is preferably 100 mm or less from the viewpoint of reducing the height of the antenna device 101A, and is more preferably 70 mm or less.

The end portion 63 located at a bottom portion of the plate surface 66 is connected to the feeding portion 62. The end portion 63 may be connected to the feeding portion 62 by directly being in contact with the feeding portion 62, or may be connected to the feeding portion 62 by capacitive coupling and the like.

The feeding portion 62 has, for example, the conductor plate 10 as a ground reference. The feeding portion 62 may be located on a virtual straight line passing through the feeding portion 3 and parallel to the X-axis direction, or may be shifted from the virtual straight line in the Y-axis direction.

Subsequently, the position of the feeding portion 62 in the X-axis direction will be explained. Herein, the shortest distance from the end portion 14 to the feeding portion 3 is denoted as A, and the shortest distance from the end portion 14 to the feeding portion 62 is denoted as B. At this occasion, B/A is preferably 0.15 or more and 0.40 or less to reduce a correlation coefficient between the radiating elements (the conductor plates 10, 20, 30) fed by the feeding portion 3 and the radiating element (the second antenna 60A) fed by the feeding portion 62. The interference between radiating elements can be reduced by lowering the correlation coefficient. In order to reduce the correlation coefficient between the radiating elements, B/A is preferably 0.20 or more and 0.40 or less, more preferably 0.22 or more and 0.38 or less, and still more preferably 0.24 or more and 0.36 or less. When B/A becomes more than 0.40, the second antenna 60A is too close to the conductor plate 20, and therefore, the interference between the conductor plate 10 and the second antenna 60A may increase. When B/A is less than 0.15, the second antenna 60A is too close to the end portion 14, which may disturb the flow of the current along the end portion 14 and may reduce the antenna gain of the radiating element fed by the feeding portion 3.

One end of the coaxial cable is connected to the feeding portion 62 directly by solder or the like or indirectly by a connector or the like. The other end of the coaxial cable is connected to a device having at least one of, for example, a transmission function and a reception function. A second feeding line 61 (see FIG. 1) connected to the feeding portion 62 may be in the same form as or in a form different from the feeding line 6 (see FIGS. 2, 3) connected to the feeding portion 3.

In FIG. 13, in order to improve the antenna gain of the antenna device 101A, the second feeding line 61 (see FIG. 1) connected to the feeding portion 62 is preferably configured to pass through an area between the feeding portion 3 and the end portion 13 rather than passing through an area between the feeding portion 62 and the end portion 14. When the second feeding line 61 passes through the area between the feeding portion 62 and the end portion 14, the current flowing along the end portion 14 is disturbed by the presence of the second feeding line 61, and the antenna gain of the antenna device 101A may decrease. That is, it is preferable that the second feeding line 61 does not pass through the area between the feeding portion 62 and the end portion 14.

For example, the second feeding line 61 (see FIG. 1) extends from the end portion 13 toward the feeding portion 3, and passes through one side in the Y-axis direction of the feeding portion 3, and connects to the feeding portion 62. The second feeding line 61 may or may not have a portion extending along the feeding line 6 connected to the feeding portion 3.

The second feeding line 61 (see FIG. 1) may pass through the opening portion 36. When the second feeding line 61 is passed through the opening portion 36 provided in the central portion of the counter portion 31, the degree of coupling between the radio frequency current flowing along the outer edge of the counter portion 31 and the radio frequency current flowing in proximity to the second feeding line 61 can be reduced. Therefore, the impedance characteristics and the radiation characteristics of the antenna device 101A are less affected by the radio frequency current flowing in proximity to the second feeding line 61 passing through the opening portion 36. For example, when the coaxial cable of the second feeding line 61 crosses a side edge of the conductor plate 10 located in the Y-axis direction instead of passing through the opening portion 36 in the X-axis direction, the radio frequency current flowing along the side edge is likely to couple with the radio frequency current flowing around the coaxial cable. This coupling may disturb the impedance characteristics and the radiation characteristics.

The feeding portion 62 may be connected to the coaxial cable via a matching circuit, which can further broaden the frequency range to which the antenna device 101A including the second antenna 60A can be matched. The matching circuit connected to the feeding portion 62 may be in the same form as or in a form different from the matching circuit 40 (see FIG. 4) connected to the feeding portion 3.

The feeding portion 62 may be connected to the coaxial cable via a duplexer. When the duplexer is provided, the single antenna device 101A can be shared by multiple communication devices using different frequency bands. The duplexer connected to the feeding portion 62 may be in the same form as or in a form different from the duplexer 50 (see FIG. 5) connected to the feeding portion 3.

Figure 14:
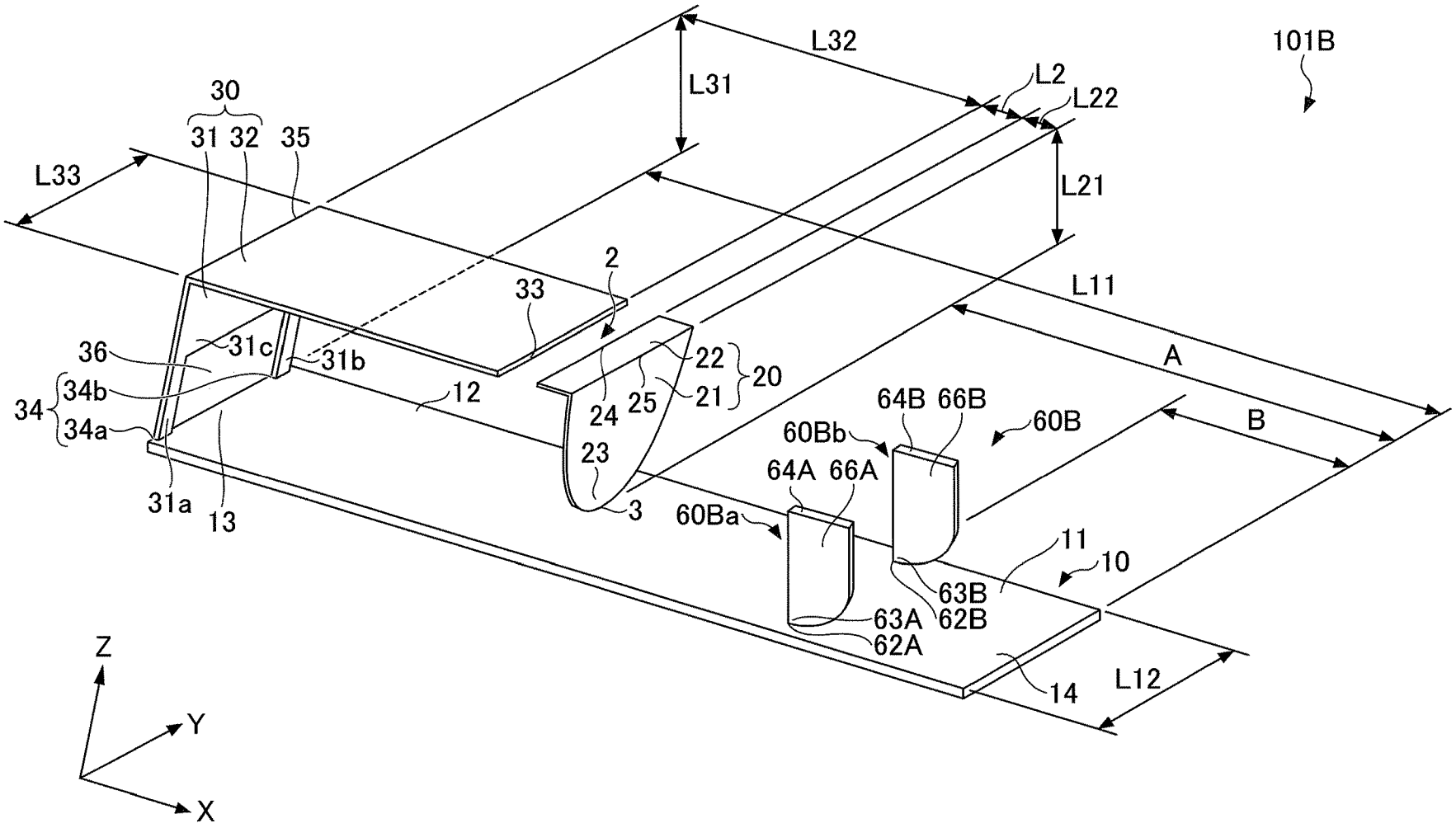
FIG. 14 is a perspective view illustrating a second modification of the configuration of the antenna device according to the present embodiment.

FIG. 14 is a perspective view illustrating a second modification of the configuration of the antenna device according to the present embodiment. The antenna device 101B as illustrated in FIG. 14 is the second modification of the configuration of the antenna device 101. The antenna device 101B includes a second antenna 60B and second feeding portions 62A, 62B. The second antenna 60B is an example of the above-described second antenna 60. With regard to configurations and effects of the antenna device 101B according to the second modification similar to the configurations and effects of the antenna devices 101, 101A, the explanation thereabout is omitted by incorporating the above explanation herein by reference.

The second antenna 60B may be constituted by a plurality of antenna elements provided on the same side as the end portion 14 with respect to the plate surface 21. In the case of FIG. 14, the second antenna 60B includes a first antenna element 60Ba and a second antenna element 60Bb. A feeding portion 62A is provided on the conductor plate 10 and supplies power to the first antenna element 60Ba, and a feeding portion 62B is provided on the conductor plate 10 and supplies power to the second antenna element 60Bb. The feeding portions 62A and 62B are both located between the end portion 14 and the feeding portion 3. Since the antenna device 101B has such a configuration, the antenna device 101B operates in a first operation mode in which the conductor plate 20 operates as a radiating element, a second operation mode in which the conductor plates 10, 30 operate as a radiating element, a third operation mode in which the first antenna element 60Ba operates as a radiating element, and a fourth operation mode in which the second antenna element 60Bb operates as a radiating element. In other words, the single antenna device 101B can achieve the four operation modes.

The first antenna element 60Ba includes an end portion 63A connected to the feeding portion 62A and an end portion 64A located at a position away from the conductor plate 10. The second antenna element 60Bb includes an end portion 63B connected to the feeding portion 62B and an end portion 64B located at a position away from the conductor plate 10.

The first antenna element 60Ba includes a plate surface 66A of which the width in a direction parallel to the conductor plate 10 (in the case of FIG. 14, the X-axis direction) increases with a distance from the end portion 63A toward the end portion 64A. The second antenna element 60Bb includes a plate surface 66B of which the width in a direction parallel to the conductor plate 10 (in the case of FIG. 14, the X-axis direction) increases with a distance from the end portion 63B toward the end portion 64B.

The first antenna element 60Ba has a plate surface 66A in a shape of an approximate quadrant, and the second antenna element 60Bb has a plate surface 66B in a shape of an approximate quadrant. However, the shapes of the plate surfaces 66A, 66B are not limited to the shape of the approximate quadrant, and may be other shapes such as semicircular, inverted triangular, and semielliptical shapes. Also, a slot may be formed in the plate surfaces 66A, 66B. The plate surfaces 66A, 66B are formed in the shapes such as the approximate quadrants having smaller areas than semicircles, and therefore, even when an antenna for the satellite positioning system or the like is further mounted between the plate surface 66A and the plate surface 66B, the interference between the antennas can be reduced.

Subsequently, the position of the feeding portions 62A, 62B in the X-axis direction will be explained. Herein, the shortest distance from the end portion 14 to the feeding portion 3 is denoted as A, and the shortest distance from the end portion 14 to the feeding portion 62A is denoted as B. At this occasion, B/A is preferably 0.15 or more and 0.40 or less to reduce a correlation coefficient between the radiating elements (the conductor plates 10, 20, 30) fed by the feeding portion 3 and the radiating element (the first antenna element 60Ba) fed by the feeding portion 62A. This is also applicable to the shortest distance B from the end portion 14 to the feeding portion 62B. The shortest distance from the end portion 14 to the feeding portion 62A and the shortest distance from the end portion 14 to the feeding portion 62B may be the same as or different from each other.

Figure 15:
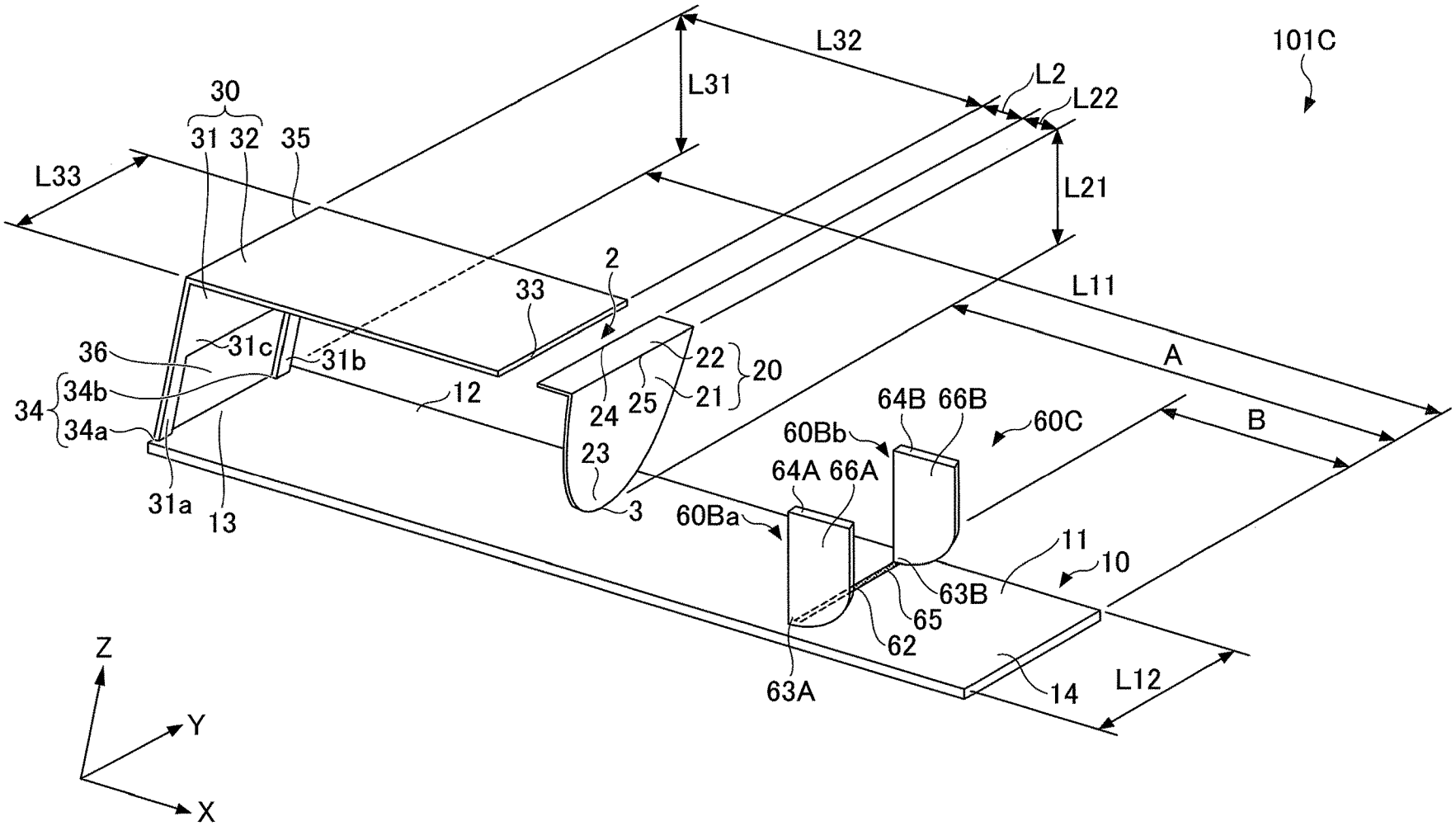
FIG. 15 is a perspective view illustrating a third modification of the configuration of the antenna device according to the present embodiment.

FIG. 15 is a perspective view illustrating a third modification of the configuration of the antenna device according to the present embodiment. The antenna device 101C as illustrated in FIG. 15 is the third modification of the configuration of the antenna device 101. The antenna device 101C includes a second antenna 60C and a feeding portion 62. The second antenna 60C is an example of the above-described second antenna 60. With regard to configurations and effects of the antenna device 101C according to the third modification similar to the configurations and effects of the antenna devices 101, 101A, 101B, the explanation thereabout is omitted by incorporating the above explanation herein by reference.

In the second antenna 60C, the first antenna element 60Ba and the second antenna element 60Bb are fed by a common feeding portion 62. For example, the feeding portion 62 is connected to the end portion 63A of the first antenna element 60Ba via a conductor 65, and is connected to the end portion 63B of the second antenna element 60Bb via the conductor 65. Since the first antenna element 60Ba and the second antenna element 60Bb are fed by the common feeding portion 62, the frequency band of the second antenna 60C can be broadened.

Figure 16:
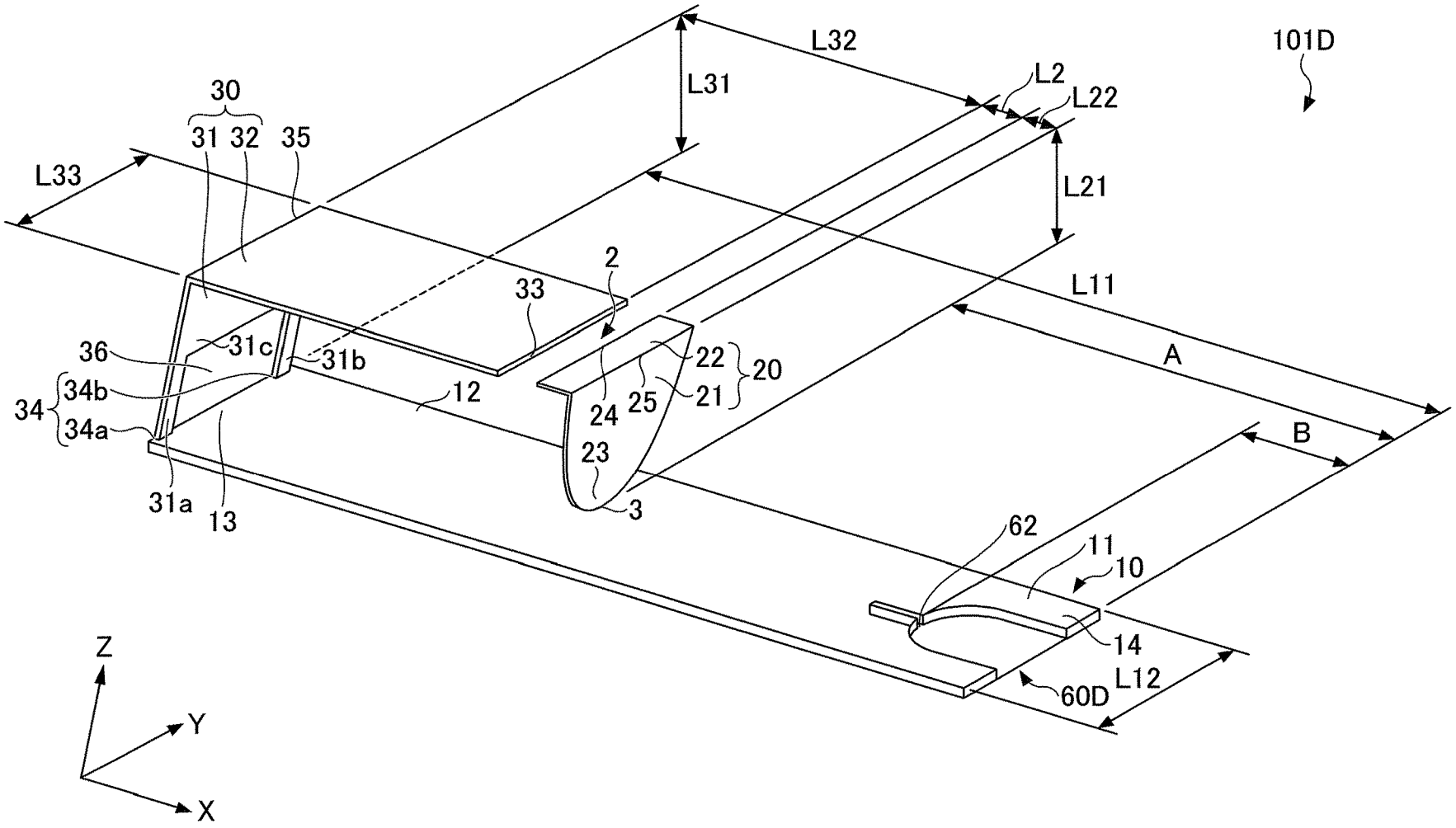
FIG. 16 is a perspective view illustrating a fourth modification of the configuration of the antenna device according to the present embodiment.

FIG. 16 is a perspective view illustrating a fourth modification of the configuration of the antenna device according to the present embodiment. The antenna device 101D as illustrated in FIG. 16 is the fourth modification of the configuration of the antenna device 101. The antenna device 101D includes a second antenna 60D and a feeding portion 62. The second antenna 60D is an example of the above-described second antenna 60. With regard to configurations and effects of the antenna device 101D according to the fourth modification similar to the configurations and effects of the antenna devices 101, 101A, 101B, 101C, the explanation thereabout is omitted by incorporating the above explanation herein by reference.

The second antenna 60D is a slot antenna provided on the same side as the end portion 14 with respect to the plate surface 21. The feeding portion 62 is provided in the conductor plate 10, and is a feeding point for feeding power to the second antenna 60D. The feeding portion 62 is located between the end portion 14 and the feeding portion 3. The second antenna 60D includes a slot of which the width in a direction parallel to the conductor plate 10 (in the case of FIG. 16, the Y-axis direction) increases with a distance from the feeding portion 62 toward the end portion 14. The slot may be a void or may be filled with a dielectric.

The conductor plate 20 fed by the feeding portion 3 is a vertically polarized antenna, whereas the second antenna 60D is a horizontally polarized antenna. Therefore, the degree of interference between the two antennas is relatively low. Therefore, even when A/B exceeds 0.40, the antenna gain of the antenna device 101D decreases less greatly than the antenna device 101A, and therefore, the position of the feeding portion 62 in the X-axis direction can be determined to be any position. In order to secure the gain over a broad frequency band and secure the horizontal plane symmetry of the directivity, the feeding portion 62 may be arranged preferably in a range of ±10% from the center in the width of the conductor plate 10 with respect to the width of the conductor plate 10, more preferably in a range of ±5% with respect to the width, and still more preferably arranged at the center of the width. Further, the width of the slot is determined to be smaller than the width of the conductor plate 10 so that the end portions 14 of the conductor plate 10 are present on both sides of the slot in the Y-axis direction. This is because, as described above, the radio frequency current does not appreciably flow in the central portion of the counter portion 31 but readily flows along the outer edges of the counter portion 31, and accordingly, the above configuration of the slot prevents disturbing the electrical operation achieved with the current is flowing through the conductor plates 10, 30 in the second operation mode.

Figure 17:
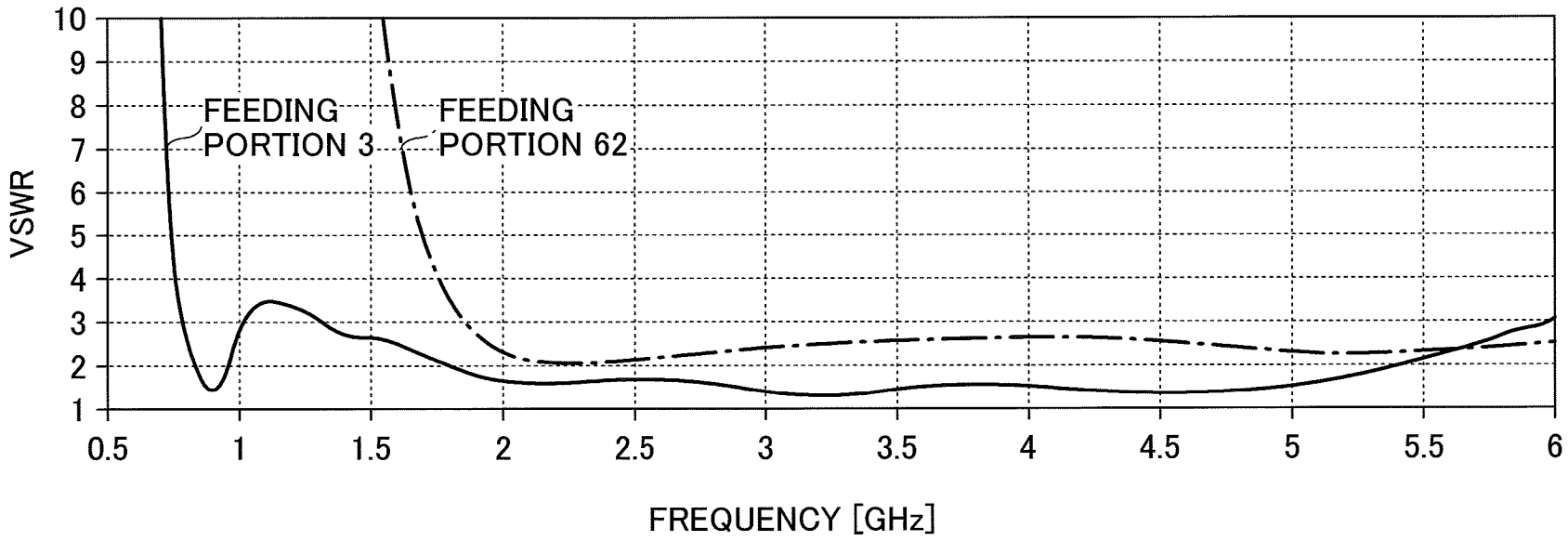
FIG. 17 illustrates an example of frequency characteristics of a VSWR (voltage standing wave ratio) of the antenna device according to the first modification.

FIG. 17 illustrates an example of frequency characteristics of a voltage standing wave ratio (VSWR) of the antenna device 101A. With respect to the characteristics of the antenna, the VSWR is preferably as close to 1 as possible. FIG. 17 illustrates a case where a matching circuit is connected to each of the feeding portion 3 and the feeding portion 62. As illustrated in FIG. 17, in the LTE and 5G frequency bands (1.7 GHz or more and 6 GHz or less), both of the radiating elements (the conductor plates 10, 20, 30) fed by the feeding portion 3 and the radiating element (second antenna 60A) fed by the feeding portion 62 have broadened frequency bands.

Figure 18:
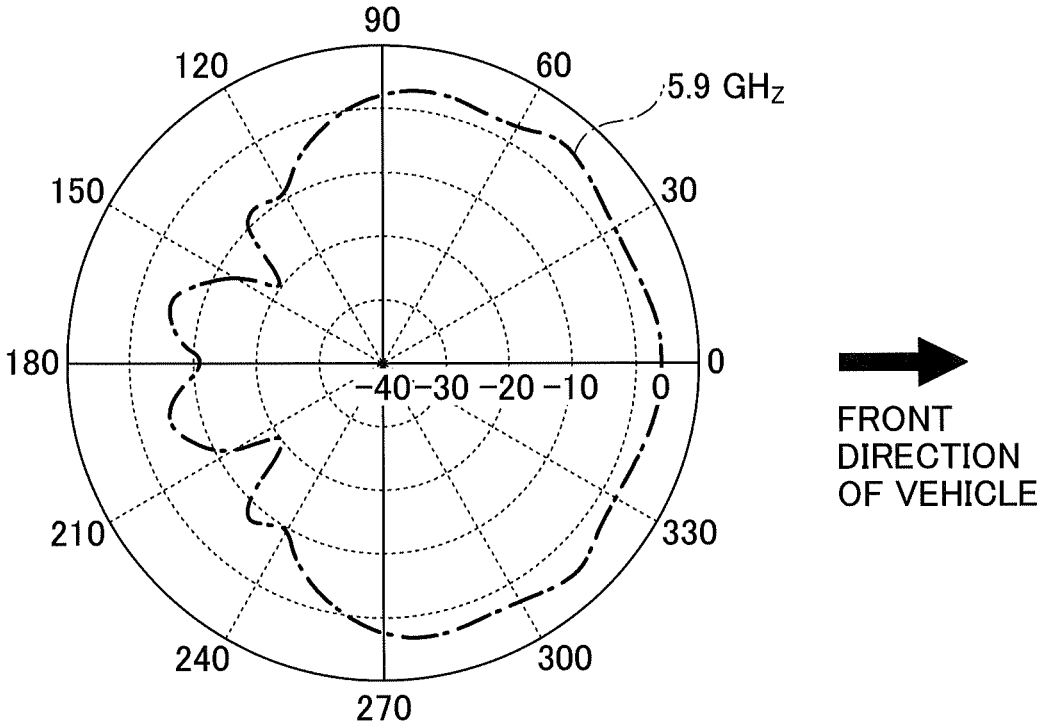
FIG. 18 illustrates an example of a radiation pattern in the horizontal plane of the antenna device according to the first modification.

FIG. 18 illustrates the antenna gain, measured at 5.9 GHz in the horizontal plane, of the antenna device 101A arranged in proximity to the windshield of a vehicle. A right side, a left side, an upper side, and a lower side of the concentric circles illustrated in FIG. 18 indicate a vehicle-front direction, a vehicle-rear direction, a vehicle-left direction, and a vehicle-right direction, respectively, when the antenna device located in the center of the concentric circle is seen from above.

As illustrated in FIG. 18, the unit of the antenna gain is "dBi". As illustrated in FIG. 18, when the antenna device 101A was arranged in proximity to the windshield of the vehicle, a radiation pattern for multiple modes in which the directivity is oriented toward the vehicle-front direction was able to be formed. Therefore, when another antenna device 101A having the same configuration is additionally arranged in proximity to the rear glass of the vehicle, a radiation pattern approaching omnidirectionality can be obtained.

Figure 19:
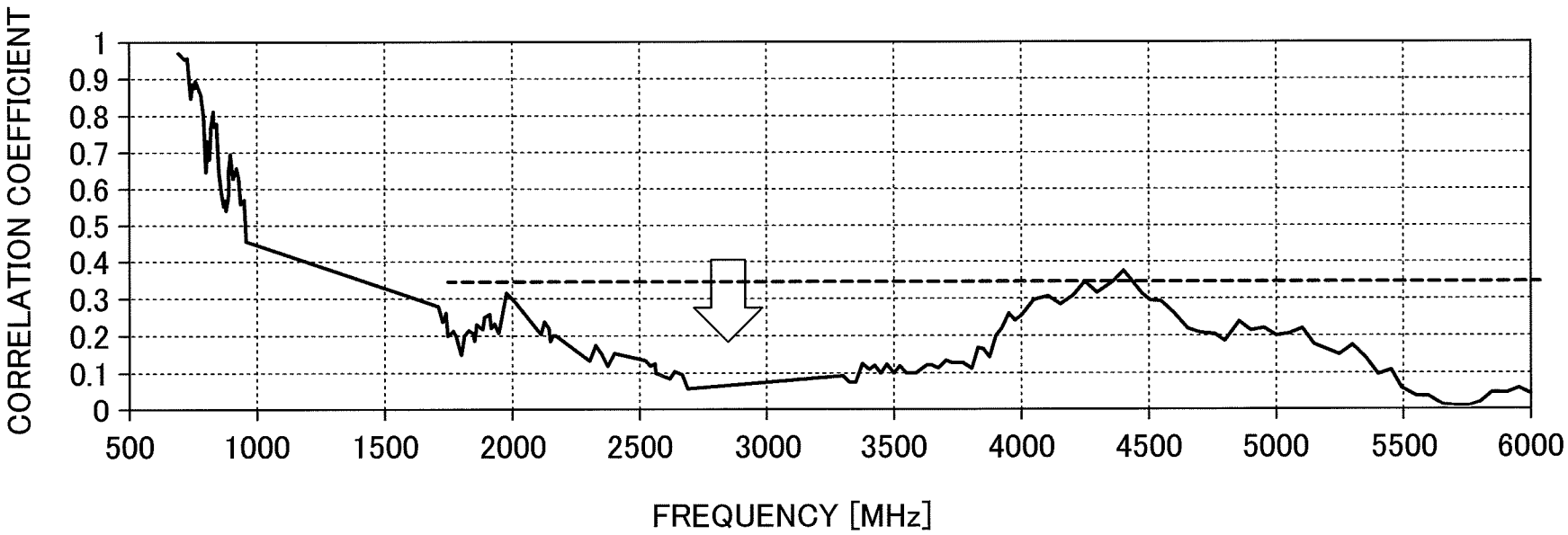
FIG. 19 illustrates an example of a correlation coefficient of the antenna device according to the first modification.

FIG. 19 is a figure illustrating a correlation coefficient of the antenna device 101A. The correlation coefficient as illustrated in FIG. 19 represents an envelope correlation coefficient (ECC) between the radiating elements (the conductor plates 10, 20, 30) fed by the feeding portion 3 and the radiating element (the second antenna 60A) fed by the feeding portion 62. As illustrated in FIG. 19, in the LTE and 5G frequency bands (1.7 GHz or more and 6 GHz or less), the correlation coefficient between both of the radiating elements was about 0.3 or less, and therefore, the degree of interference between both of the radiating elements was relatively small. Therefore, the antenna device 101A can be used as a MIMO antenna.

When the data as illustrated in FIGS. 17 to 19 were measured, the sizes of respective portions of the antenna device 101A as illustrated in FIG. 13 were as follows, which are expressed in a unit of "mm".

L2: 4
L11: 95
L12: 40
L21: 19
L22: 5
L31: 20
L32: 30
L33: 40
L60: 15
L61: 19
A: 50
B: 15

The radius of curvature of the curved line portion extending from the end portion 63 of the plate surface 66 is 8 mm.

Hereinabove, the antenna device and the window glass for the vehicle have been explained with reference to embodiment, but the present invention is not limited to the above embodiment. Various modifications and improvements, such as combinations or replacements with a part or all of another embodiment, are possible within the scope of the present invention.

An example of a window glass to which the present invention can be applied includes a windshield attached to a front portion of a vehicle. It should be noted that the window glass may be a rear glass attached to a rear portion of a vehicle, or may be a side glass attached to a side portion of a vehicle.

Further, in the above-mentioned embodiment, a glass plate is shown as an example of a base member to which the antenna device is attached, but the base member is not limited to the glass plate and may be other members. The base member may cover the antenna device. The antenna device may be attached to the glass plate with the base member interposed therebetween. The material of the base member is preferably dielectric.

The forms of segments constituting an antenna conductor is not limited to a linearly extending shape, and may be in a shape extending in a curved manner with a rounded shape. The shape of the corner portion of the antenna conductor is not limited to a right angle, and may be rounded in a shape of an arc.

The conductor plate is not limited to a simple flat plate, and may be bent. In addition, each conductor plate may be made by connecting two or more conductor plates.

The single antenna device according to the present embodiment may be attached to an upper area in the central portion in the vehicle-width direction of the windshield, or the single antenna device according to the present embodiment may be attached to an upper area in the central portion in the vehicle-width direction of the rear glass.

Multiple antenna devices according to the present embodiment may be attached, with a gap in the vehicle-width direction, on the windshield (preferably, in an upper area extending in the vehicle-width direction of the vehicle). As a result, the correlation between the antenna devices is reduced by securing a certain distance between the antenna devices, so that an antenna system that supports MIMO (Multiple Input and Multiple Output) can be provided. In addition, the antenna devices can be used as diversity antennas. The above is also applicable to a case where multiple antenna devices according to the present embodiment are attached, with a gap in the vehicle-width direction, on the rear glass (preferably, in an upper area extending in the vehicle-width direction of the vehicle).

At least one antenna device according to the present embodiment may be attached to each of the windshield and the rear glass. In other words, a window glass structure including a windshield for a vehicle, a rear glass for the vehicle, and at least one antenna device according to the present embodiment, attached to each of the windshield and the rear glass can be provided. According to such a window glass structure, the directivity in the vehicle-longitudinal direction can be complemented, and the transmission and reception performance of the antenna system can be improved. In addition, since the distance between the antenna devices can be secured to some extent, the correlation between the antenna devices is reduced, and an antenna system that supports MIMO (for example, 4×4 MIMO (four-by-four MIMO)) can be provided.

Furthermore, an antenna system that includes at least one antenna device according to the present embodiment attached to a windshield and at least one antenna device of a type different from the at least one antenna device according to the present embodiment can also be provided. Examples of antenna devices of different types in this case include a shark fin antenna, a spoiler-embedded antenna, an antenna installed in a rear tray, an antenna embedded in a side mirror, an antenna famed with side glass, and the like.

Likewise, an antenna system that includes at least one antenna device according to the present embodiment attached to a rear glass and at least one antenna device of a type different from the at least one antenna device according to the present embodiment can also be provided. Examples of antenna devices of different types in this case include an antenna embedded in an instrument panel, an antenna embedded in a dashboard, an antenna embedded in a side mirror, an antenna formed with side glass, and the like.

A combination of at least one of these antenna devices of different types and at least one antenna device according to the present embodiment attached to a windshield or a rear glass can provide an antenna system that supports MIMO (for example, 4×4 MIMO).

What is claimed is:

1. An antenna device comprising:

a first conductor plate including a first end portion and a second end portion on an opposite side from the first end portion, the first conductor plate being provided with a first feeding portion between the first end portion and the second end portion;

a second conductor plate including a third end portion connected to the first feeding portion, a fourth end portion located at a position away from the first conductor plate, and a planar plate surface of which width in a direction parallel to the first conductor plate increases with a distance from the third end portion toward the fourth end portion; and a third conductor plate including a fifth end portion capacitively coupling with the fourth end portion, a sixth end portion connected, on a same side as the first end portion with respect to the first feeding portion, to the first conductor plate, and a counter portion opposite the planar plate surface, wherein the counter portion is parallel to the planar plate surface, wherein the counter portion has an opening portion and a first feeding line connected to the first feeding portion passes through the opening portion, wherein the third conductor plate has a constant width in a second direction, which is (a) perpendicular to a first direction between the first end portion and the second end portion and (b) parallel to a surface of the first conductor plate.

2. The antenna device according to claim 1, wherein the second conductor plate has a first electrical length resonating at a first operation frequency, and the first conductor plate and the third conductor plate have a second electrical length resonating at a second operation frequency lower than the first operation frequency.

3. The antenna device according to claim 2, wherein the first electrical length is a quarter wavelength of the first operation frequency.

4. The antenna device according to claim 2, wherein the second electrical length is a quarter wavelength of the second operation frequency.

5. The antenna device according to claim 2, wherein the counter portion and the planar plate surface are apart by an electrical length of a quarter wavelength of the first operation frequency.

6. The antenna device according to claim 1, wherein the third conductor plate has a second counter portion opposite the first conductor plate.

7. The antenna device according to claim 6, wherein the second counter portion is parallel to the first conductor plate.

8. The antenna device according to claim 1, wherein a shape of the planar plate surface is axisymmetric about a virtual line passing through the first feeding portion.

9. The antenna device according to claim 1, wherein the planar plate surface has a semi-circular shape.

10. The antenna device according to claim 1, wherein in the second conductor plate, the fourth end portion is bent to come into proximity with the fifth end portion.

11. The antenna device according to claim 1, wherein a conductor length from the third end portion to the fourth end portion is 100 mm or less.

12. The antenna device according to claim 1, wherein the first feeding portion is located at a central portion of the first conductor plate in a direction parallel to the planar plate surface.

13. The antenna device according to claim 1, wherein the first feeding portion is connected to a coaxial cable via a matching circuit.

14. The antenna device according to claim 1, wherein the first feeding portion is connected via a duplexer to a coaxial cable.

15. The antenna device according to claim 1, further comprising:

an antenna provided on a same side as the second end portion with respect to the planar plate surface; and a second feeding portion provided on the first conductor plate and configured to feed power to the antenna, wherein the second feeding portion is located between the second end portion and the first feeding portion.

16. The antenna device according to claim 15, wherein where a shortest distance from the second end portion to the first feeding portion is denoted as A, and a shortest distance from the second end portion to the second feeding portion is denoted as B, B/A is 0.15 or more and 0.40 or less.

17. The antenna device according to claim 15, wherein the antenna has a second planar plate surface of which width in a direction parallel to the first conductor plate increases with a distance from the first conductor plate.

18. The antenna device according to claim 15, wherein a second feeding line connected to the second feeding portion passes through an area between the second feeding portion and the first end portion.

19. A window glass for a vehicle, comprising:

a glass plate for window of the vehicle; and at least one antenna device as recited in claim 1, attached to the glass plate.

20. A window glass structure comprising:

a windshield for a vehicle;

a rear glass for the vehicle; and at least one antenna device as recited in claim 1, attached to each of the windshield and the rear glass.

21. The antenna device according to claim 1, wherein a maximum width of each of the first conductor plate, the second conductor plate and the third conductor plate in the second direction is the same.

22. The antenna device according to claim 1, wherein the third conductor plate constitutes a single piece.

* * * * *